US008213834B2

(12) United States Patent
Takai et al.

(10) Patent No.: US 8,213,834 B2
(45) Date of Patent: Jul. 3, 2012

(54) PHOTOCONDUCTIVE DRUM AND IMAGE FORMING APPARATUS HAVING THE SAME

(75) Inventors: Shingo Takai, Ibaraki (JP); Youichi Takeuchi, Ibaraki (JP); Tomohiko Saito, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 363 days.

(21) Appl. No.: 12/692,975

(22) Filed: Jan. 25, 2010

(65) Prior Publication Data

US 2010/0221041 A1 Sep. 2, 2010

(30) Foreign Application Priority Data

Feb. 27, 2009 (JP) ..... 2009-047265

(51) Int. Cl.
*G03G 15/00* (2006.01)

(52) U.S. Cl. ..... 399/159; 399/107; 399/116; 399/117

(58) Field of Classification Search ..... 399/107, 399/116, 117, 159
See application file for complete search history.

(56) References Cited

U.S. PATENT DOCUMENTS

| | | | | |
|---|---|---|---|---|
| 4,134,669 | A * | 1/1979 | Reitner | 399/130 |
| 4,527,883 | A * | 7/1985 | Kamiyama | 399/117 |
| 2007/0253729 | A1* | 11/2007 | Takagi | 399/117 |
| 2008/0199213 | A1* | 8/2008 | Saito et al. | 399/117 |

FOREIGN PATENT DOCUMENTS

| | | |
|---|---|---|
| JP | 2-502130 | 7/1990 |
| JP | 4087305 | 2/2008 |
| JP | 2008-145511 | 6/2008 |
| JP | 2008-203425 | 9/2008 |
| WO | WO 88/05931 | 8/1988 |

* cited by examiner

*Primary Examiner* — Ryan Walsh
(74) *Attorney, Agent, or Firm* — Oblon, Spivak, McClelland, Maier & Neustadt, L.L.P.

(57) ABSTRACT

A disclosed photoconductive drum includes a mechanism where, when the sleeve inner circumferential surface pressing member is in contact with the inner circumferential surface of the photoconductive sleeve member, a displacement of the first end surface member with respect to the photoconductive sleeve member in the center line direction leads to increasing a pressing force applied from the sleeve inner circumferential surface pressing member to the inner circumferential surface of the photoconductive sleeve member.

6 Claims, 22 Drawing Sheets

PHOTOCONDUCTIVE DRUM AND IMAGE FORMING APPARATUS HAVING THE SAME

CROSS-REFERENCE TO RELATED APPLICATIONS

The present application claims priority under 35 U.S.C §119 to Japanese Patent Application No. 2009-047265 filed Feb. 27, 2009, the entire contents of which are hereby incorporated herein by reference.

BACKGROUND OF THE INVENTION

1. Field of the Invention

The present invention generally relates to a photoconductive drum to be used in an electrophotographic image forming apparatus such as a copier, a printer, and a facsimile machine and an image forming apparatus having the photoconductive drum.

2. Description of the Related Art

A photoconductive drum having a cylindrical shape in an electrophotographic image forming apparatus is required to be replaced periodically because the surface of the photoconductive drum may be worn out and the electrical characteristics of the surface may be deteriorated in accordance with the number of printed pages and the like. Some types of photoconductive drums have a photoconductive sleeve member and a wheel member, the photoconductive sleeve member having a cylindrical shape and having an outer circumference surface on which a photoconductive layer is formed, the wheel member being provided for establishing the connection between the photoconductive sleeve member and the driving shaft of the main body of the image forming apparatus. There are generally two methods of replacing the photoconductive drum having the photoconductive sleeve member and the wheel member. One is to replace the entire photoconductive drum with the photoconductive sleeve member and the wheel member. The other method is to separate the photoconductive sleeve member from the wheel member with each other and replace the photoconductive sleeve member only so that the wheel member can be repeatedly used (reused). In comparison between those two method, the method of replacing the photoconductive sleeve member only may have some advantages including that a fewer number of parts may be required to be replaced in replacing the photoconductive drum and that the running cost of the image forming apparatus may be more reduced. Because of the advantages, from the viewpoint of the cost, the method of replacing the photoconductive sleeve member only has been more widely used as the method of replacing the photoconductive drum especially in the image forming apparatuses in which the printing speed is relatively high and a relatively large number of pages are to be printed during the service life. This is because the frequency of replacing the photoconductive drum is higher in such image forming apparatus.

However, in a case where the method of replacing the photoconductive sleeve member only is adopted, if an operator touches the surface of the used photoconductive sleeve member, the hand of the operator may be stained due to dirt on the surface. Furthermore, if the operator touches the surface of a new photoconductive sleeve member to be used, the stain on the hand of the operator may be adhered to the surface of the photoconductive sleeve member and/or the surface of the photoconductive sleeve member may be damaged, thereby degrading the image quality. Therefore, it is required to pay particular attention so as not to touch the surface of the photoconductive sleeve member during the replacement.

Because of the restriction that the operator cannot touch the surface of the photoconductive sleeve member, in the apparatus in which only the photoconductive sleeve member is to be replaced, it may take longer to complete the replacement of the photoconductive drum, thereby increasing the repair and maintenance cost. Some efforts have been made to overcome the problem.

For example, Japanese Patent Application Publication No. H02(1990)-502130 describes an image forming apparatus in which only the photoconductive sleeve member can be replaced without any necessity of touching the surface of the photoconductive sleeve member. FIGS. 1 and 2 show an example of the conventional photoconductive drum 100 of the image forming apparatus. As shown in the figures, the photoconductive sleeve member 1 is replaceable with respect to the apparatus main body. FIG. 1 is a cross-sectional view when cut along the center line of the conventional photoconductive drum 100. FIG. 2 is a cross-sectional view of the cross section perpendicular to the center line of the photoconductive drum 100. More specifically, FIG. 2 is the cross-sectional view of the cross section when cut along line A-A' of FIG. 1; and FIG. 1 is the cross-sectional view of the cross section when cut along line B-B' of FIG. 2.

Further, FIGS. 3A and 3B show a process of attaching and detaching the photoconductive sleeve member 1 of the photoconductive drum 100 to and from a driving shaft 4 of the apparatus main body.

As shown in FIGS. 1 and 2, the photoconductive drum 100 includes the photoconductive sleeve member 1 having a hollow cylindrical shape, a cap member 2, and a wheel member 3. The cap member 2 serves as a first end surface member capable of engaging with one end of the photoconductive sleeve member 1 in the center line direction. The wheel member 3 serves as a second end surface member capable of engaging with the other end of the of the photoconductive sleeve member 1 in the center line direction. The driving shaft 4 transmits drive torque the photoconductive drum 100 and is supported by shaft bearing members (not shown) of the image forming apparatus, the shaft bearing members being provided at both ends of the driving shaft 4 in the centerline direction. Further, the wheel member 3 is fixed to the driving shaft 4, and the cap member 2 and a handle 5 (FIG. 1) are removably attached to the driving shaft 4.

One end side of the cylindrical-shaped photoconductive sleeve member 1 is engaged with the outer circumference of the cap member 2 which is fixed to a small diameter part 4*b* of the driving shaft 4. On the other hand, the other end side of the cylindrical-shaped photoconductive sleeve member 1 is engaged with outer circumference of the wheel member 3 fixed to a stepping part 4*c* formed between the small diameter part 4*b* and a large diameter part 4*a* of the driving shaft 4. Further, by screwing the handle 5 into the end portion of the small diameter part 4*b* of the driving shaft 4, the photoconductive sleeve member 1 is sandwiched between a cap flange section 2*f* of the cap member 2 and a wheel flange section 3*f* of the wheel member 3. As a result, the photoconductive sleeve member 1 is fixed in position with respect to the driving shaft 4. Further, the wheel member 3 serves as a guide member capable of guiding the photoconductive sleeve member 1 when the photoconductive sleeve member 1 is attached to and detached from the main body of the image forming apparatus. To that end, the wheel member 3 includes plural ribs 30 extending along the inner circumferential surface of the photoconductive sleeve member 1.

Further, in the photoconductive sleeve member 1, there is provided a deformation prevention member 7 contacting plural portions arranged in the circumferential direction on the inner circumferential surface of the photoconductive sleeve member 1. As shown in FIG. 2, the deformation prevention member 7 includes a first prevention piece 71 and a second prevention piece 72. The first prevention piece 71 and the second prevention piece 72 are engaged with each other at an engaging section 70 having a concavo-convex shape, so that the first prevention piece 71 and the second prevention piece 72 can pivotably rotate about the engaging section 70 due to a pressing force generated by a strut spring 73. The strut spring 73 is provided in between the first prevention piece 71 and the second prevention piece 72. In the rotations, the first prevention piece 71 rotates in the arrow direction C1 and the second prevention piece 72 rotates in the arrow direction C2 in FIG. 2. By rotating in this way, the deformation prevention member 7 enlarges its circumferential dimension, thereby causing contacting sections (71*b* and 72*b* in FIG. 2) of the prevention piece 71 and the second prevention piece 72 to be in contact with the inner circumferential surface of the photoconductive sleeve member 1 to press the inner circumferential surface of the photoconductive sleeve member 1.

Further, the prevention piece 71 includes an engagement core 71*a* provided where the first prevention piece 71 and the second prevention piece 72 are pressed by the strut spring 73, so that the engagement core 71*a* can be entered into (moved through) an engage hole formed in the second prevention piece 72. Further, the strut spring 73 is disposed inside the engagement core 71*a*. Further, the second prevention piece 72 includes a fixing screw 72*a* to fix the position of the engagement core 71*a*. Therefore, by tightening the fixing screw 72*a*, it becomes possible to fix the position of the engagement core 71*a* with respect to the second prevention piece 72. By doing this, the positional relationship between the first prevention piece 71 and the second prevention piece 72 can be fixed (determined) regardless of the pressing force (status) of the strut spring 73. In this configuration, while the strut spring 73 is being compressed, by tightening the fixing screw 72*a*, the first prevention piece 71 and the second prevention piece 72 can no longer press the inner circumferential surface of the photoconductive sleeve member 1. In this situation, it becomes possible to remove the deformation prevention member 7 from inside the photoconductive sleeve member 1.

Next, a procedure of removing the photoconductive sleeve member 1 of the photoconductive drum 100 from the image forming apparatus and replacing the photoconductive sleeve member 1 is described.

To replace the photoconductive sleeve member 1, as shown in FIG. 3A, first, the handle 5 is removed from the driving shaft 4. Next, the cap member 2 is removed. When the cap member 2 is removed, an opening is formed on the left-hand side of the photoconductive sleeve member 1 as shown in FIG. 3A. Through the opening, by placing the hand of an operator in the photoconductive sleeve member 1, the operator can grasp the deformation prevention member 7. In this situation, the fixing screw 72*a* is not tightened. Therefore, due to the pressing force of the strut spring 73, the contacting sections (71*b* and 72*b* in FIG. 2) of the prevention piece 71 and the second prevention piece 72 are in contact with the inner circumferential surface of the photoconductive sleeve member 1 and pressing the inner circumferential surface. As a result, the deformation prevention member 7 is fixed in position with respect to the photoconductive sleeve member 1 so that the deformation prevention member 7 and the photoconductive sleeve member 1 are integrated with each other. In this situation, when the operator grasps the deformation prevention member 7 as a handle member and then pulls the deformation prevention member 7 to the left-hand side in FIG. 3A, the photoconductive sleeve member 1 can be removed from the driving shaft 4 and the wheel member 3. That is, the photoconductive sleeve member 1 can be removed from the main body of the image forming apparatus.

Then, the deformation prevention member 7 is removed from the inside of the photoconductive sleeve member 1. Next, a new photoconductive sleeve member 1 is attached to the deformation prevention member 7. Then, by fixing the photoconductive sleeve member 1 with the deformation prevention member 7 to the driving shaft 4 in the procedure opposite to that of removing the photoconductive sleeve member 1 described above, the replacement of the photoconductive sleeve member 1 can be completed.

In the above method, it is true that only the photoconductive sleeve member 1 may be replaced and the deformation prevention member 7 as the handle member may be reused. However, the operation of removing the handle member disposed in the photoconductive sleeve member 1 may be so difficult that it may increase time to complete the replacement of the photoconductive sleeve member 1.

On the other hand, there may be another method in which an operator can grasp the handle member disposed in the photoconductive sleeve member to replace the photoconductive sleeve member so that the entire photoconductive sleeve member including handle member may be replaced (i.e., the handle member cannot be reused). However, from the viewpoint of saving resources, discarding the handle member in this method is a waste of resources.

Japanese Patent Application Publication No. 2008-203425 discloses a configuration including an engagement unit capable of switching between an engagement state and a non-engagement state based on the operation of an operation member. In the engagement state, an end surface member corresponding to the cap member 2 of the photoconductive drum 100 shown in FIGS. 1 through 3B is engaged with the photoconductive sleeve member. On the other hand, in the non-engagement state, the engagement between the end surface member and the photoconductive sleeve member is released. The engagement unit is provided in one of the end surface members. The engagement unit includes a sleeve inner circumferential surface pressing member. By operating the operation member, it becomes possible to switch between the engagement state and the non-engagement state. In the engagement state, the sleeve inner circumferential surface pressing member is in contact with the sleeve inner circumferential surface (i.e., the inner circumferential surface of the photoconductive sleeve member) to press the sleeve inner circumferential surface. On the other hand, in the non-engagement state, the sleeve inner circumferential surface pressing member is not in contact with the sleeve inner circumferential surface. While the sleeve inner circumferential surface pressing member is not in contact with the sleeve inner circumferential surface, the engagement between the end surface member and the photoconductive sleeve member is released. From this state where the engagement is released, by operating the operation member, the sleeve inner circumferential surface pressing member comes in contact with the sleeve inner circumferential surface to press the sleeve inner circumferential surface. By doing this, the end surface member comes in contact with the sleeve inner circumferential surface. According to the configuration described in Japanese Patent Application Publication No. 2008-203425, when the photoconductive sleeve member is to be replaced, an operator operates the operation member to engage the end surface member with the photoconductive sleeve member. Then, the operator pulls the end surface member engaged with the photoconductive sleeve member in the center line direction to integrally remove the end surface member and the photoconductive sleeve member from the other end surface member and the driving shaft. Then, the operator operates the operation member to release the engagement between the end surface member and the photoconductive sleeve member to separate the end surface member from the photoconductive sleeve member, the end surface member having been engaged with the photoconductive sleeve member and integrally removed from the driving shaft as described above. By doing this, it becomes possible to replace only the photoconductive sleeve member.

By having this configuration, the end surface member engaged with the photoconductive sleeve member and integrally removed from the driving shaft may serve as a handle member; therefore, the operator doesn't have to place a hand inside the photoconductive sleeve member to remove the handle member from the photoconductive sleeve member. As a result, it becomes possible to easily separate the handle member from the photoconductive sleeve member, and it may not increase time to complete the replacement of the photoconductive sleeve member. Further, the end surface member serving as the handle member may be reused by being engaged with a new photoconductive sleeve member. Therefore, it is not necessary to discard the end surface member, which is useful from the viewpoint of saving resources.

Further, according to the configuration described in Japanese Patent Application Publication No. 2008-203425, one end surface member engaged with the photoconductive sleeve member can be integrally removed from the other end surface member and the driving shaft. However, as an alternative configuration, two end surface members and the photoconductive sleeve member may be removed from the driving shaft. Then, one end surface member and the photoconductive sleeve member may be integrally removed from the other end surface member. In this configuration, for example, while a hand or a tool is used to serve as the separated driving shaft to fix the position of the other end surface member, by removing the end surface member from the other end surface member, it becomes possible to integrally remove the end surface member and the photoconductive sleeve member from the other end surface member.

However, in the configuration described in Japanese Patent Application Publication No. 2008-203425, the one end surface member is engaged with the photoconductive sleeve member based on a friction force exerted between the sleeve inner circumferential surface pressing member and the sleeve inner circumferential surface. Therefore, a retention force retaining the position of the photoconductive sleeve member with respect to the one end surface member by the sleeve inner circumferential surface pressing member is constant. Therefore, because of such a strong engagement between the photoconductive sleeve member and the other end surface member, when an operator integrally removes the one end surface member and the photoconductive sleeve member from the other end surface member, more force than is supposed by the design engineer may be temporarily applied to the contacting section between the sleeve inner circumferential surface pressing member and the sleeve inner circumferential surface. In this case, if the applied force exceeds the maximum static friction force between the sleeve inner circumferential surface pressing member and the sleeve inner circumferential surface, the engagement between the one end surface member and the photoconductive sleeve member may be destroyed (released). When the engagement is destroyed, the engagement between the photoconductive sleeve member and the other end surface member may not be released, thereby preventing the replacement of the photoconductive sleeve member only. Further, when, for example, an operator holds the other end surface member, and if the engagement is destroyed, the photoconductive sleeve member may be dropped off and the operator may be injured.

To avoid the problems, a new configuration may be adopted in which a biasing member such as a spring member having a higher biasing force is provided to increase the pressing force of the sleeve inner circumferential surface pressing member with respect to the sleeve inner circumferential surface. However, in a case where this method is adopted to increase the biasing force of the biasing member, while the end surface member is in contact with the photoconductive sleeve member, the higher pressing force is always applied to the contacting section between the sleeve inner circumferential surface pressing member and the sleeve inner circumferential surface including when such higher pressing force is not required. Because of this feature, it may become necessary to reinforce the members so as not to be deformed even when the higher pressing force is applied to the contacting section between the sleeve inner circumferential surface pressing member and the sleeve inner circumferential surface, thereby increasing the manufacturing costs.

SUMMARY OF THE INVENTION

The present invention is made in light of the above problems and may provide a photoconductive drum where the end surface member is engaged with the photoconductive sleeve member, and the photoconductive drum is capable of not generating a higher pressing force when it is not necessary to apply the higher pressing force to the contacting section between the sleeve inner circumferential surface pressing member and the sleeve inner circumferential surface. Further, the photoconductive drum is capable of maintaining the engagement between the end surface member and the photoconductive sleeve member even when a high force is temporarily applied to the contacting section between the sleeve inner circumferential surface pressing member and the sleeve inner circumferential surface. Further, the present invention may provide an image forming apparatus having the above photoconductive drum.

According to an aspect of the present invention, there is provided a photoconductive drum including:

a photoconductive sleeve member 1 having a hollow cylindrical shape and having a photoconductive outer circumferential surface;

a first end surface member 2 configured to be engaged with one end of the photoconductive sleeve member 1 in a center line direction of the photoconductive sleeve member 1;

a second end surface member 3 configured to be engaged with the other end of the photoconductive sleeve member 1 in the center line direction of the photoconductive sleeve member 1;

a contacting unit disposed in the first end surface member 2 and including an operation member 6, the contacting unit being configured to be operated to select between a contacting mode and a non-contacting mode due to an operation of the operation member 6, the contacting mode indicating that the first end surface member 2 is engaged with the photoconductive sleeve member 1, the non-contacting mode indicating that the engagement is released between the first end surface member 2 and the photoconductive sleeve member 1; and a sleeve inner circumferential surface pressing member 11 disposed in the contacting member and configured to be operated due to the operation of the of the operation member 6 to select between a state where the sleeve inner circumferential surface pressing member 11 is in contact with and presses an inner circumferential surface of the photoconductive sleeve member 1 so that the first end surface member 2 is engaged with the photoconductive sleeve member 1 and a state where the sleeve inner circumferential surface pressing member 11 is not in contact with and presses the inner circumferential surface of the photoconductive sleeve member 1 so that the engagement is released between the first end surface member 2 and the photoconductive sleeve member 1, wherein the photoconductive drum includes a mechanism where, when the sleeve inner circumferential surface pressing member 11 is in contact with the inner circumferential surface of the photoconductive sleeve member 1, a displacement of a position of the first end surface member 2 with respect to the photoconductive sleeve member 1 in the center line direction leads to increase a pressing force applied from the sleeve inner circumferential surface pressing member 11 to the inner circumferential surface of the photoconductive sleeve member 1.

According to an embodiment of the present invention, even when a force is applied exceeding the maximum static friction force generated between the arm member 11 and the inner circumferential surface of the photoconductive sleeve member 1 upon the cap member 2 being engaged with the photoconductive sleeve member 1 due to the operation of the operation member 6 and the position of the cap member 2 with respect to the photoconductive sleeve member 1 is displaced outward in the center line direction, the displacement of the cap member 2 leads to increase the pressing force applied from the arm member 11 to the inner circumferential surface of the photoconductive sleeve member 1. Because of this feature, the larger the displacement becomes, the larger is the pressing force is applied to the contacting sections 112*a* and 112*b* where the arm members 11 are in contact with the inner circumferential surface of the photoconductive sleeve member 1. As a result, the engagement may be reinforced between the cap member 2 and the photoconductive sleeve member 1. Because of this feature, even when an extraordinary force is temporarily applied to the contacting sections 112*a* and 112*b*, the engagement may be maintained between the cap member 2 and the photoconductive sleeve member 1. On the other hand, as long as the position of the cap member 2 with respect to the photoconductive sleeve member 1 is not displaced outward in the center line direction, the pressing force applied to the contacting sections 112*a* and 112*b* where the arm members 11 are in contact with the inner circumferential surface of the photoconductive sleeve member 1 is equal to the pressing force applied when the cap member 2 is engaged with the photoconductive sleeve member 1 due to the operation of the operation member 6. Because of this feature, when the cap member 2 is engaged with the photoconductive sleeve member 1 and if no extraordinary pressing force is required to be applied to the contacting sections 112*a* and 112*b* where the arm members 11 are in contact with the inner circumferential surface of the photoconductive sleeve member 1, such extraordinary pressing force may not be applied to the contacting sections.

Therefore, in the photoconductive drum 100 according to this embodiment of the present invention, when the cap member 2 is engaged with the photoconductive sleeve member 1 and no extraordinary pressing force is required to be applied to the contacting sections where the arm members 11 are in contact with the inner circumferential surface of the photoconductive sleeve member 1, it may become possible to avoid the application of such extraordinary pressing force to the contacting sections. Further, even when an extraordinary pressing force is temporarily applied to the contacting sections 112*a* and 112*b*, the engagement may be maintained between the cap member 2 and the photoconductive sleeve member 1.

BRIEF DESCRIPTION OF THE DRAWINGS

Other objects, features, and advantages of the present invention will become more apparent from the following description when read in conjunction with the accompanying drawings, in which.

DETAILED DESCRIPTION OF THE PREFERRED EMBODIMENTS

In the following, embodiments of the present invention applied to a printer (hereinafter referred to as a printer 200) as an image forming apparatus will be described with reference to the accompanying drawings.

Figure 1:
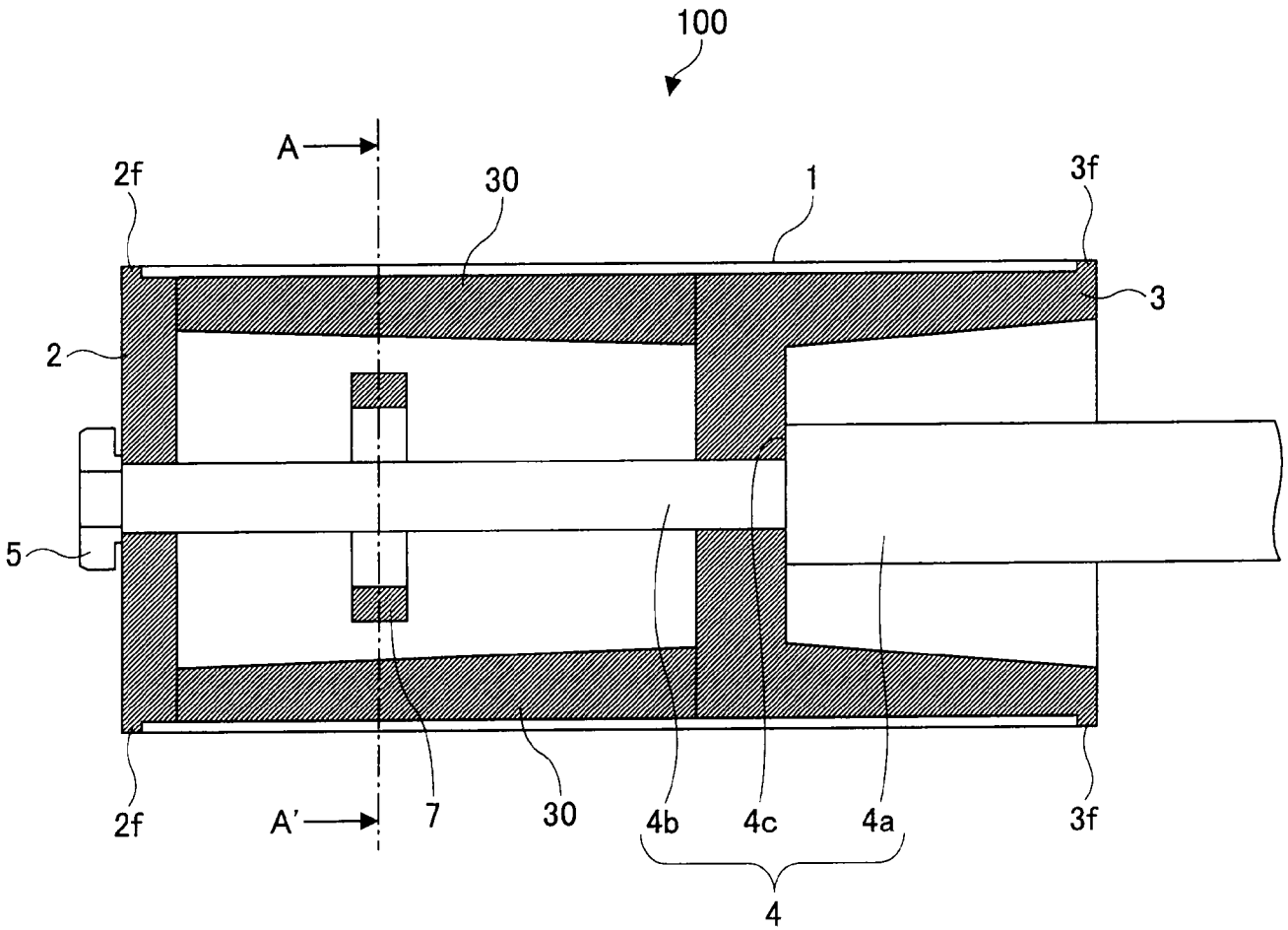
FIG.1 PRIOR ART
FIG. 1 is a cross-sectional view when cut along a vertical plane including the center line of a conventional photoconductive drum.
Figure 2:
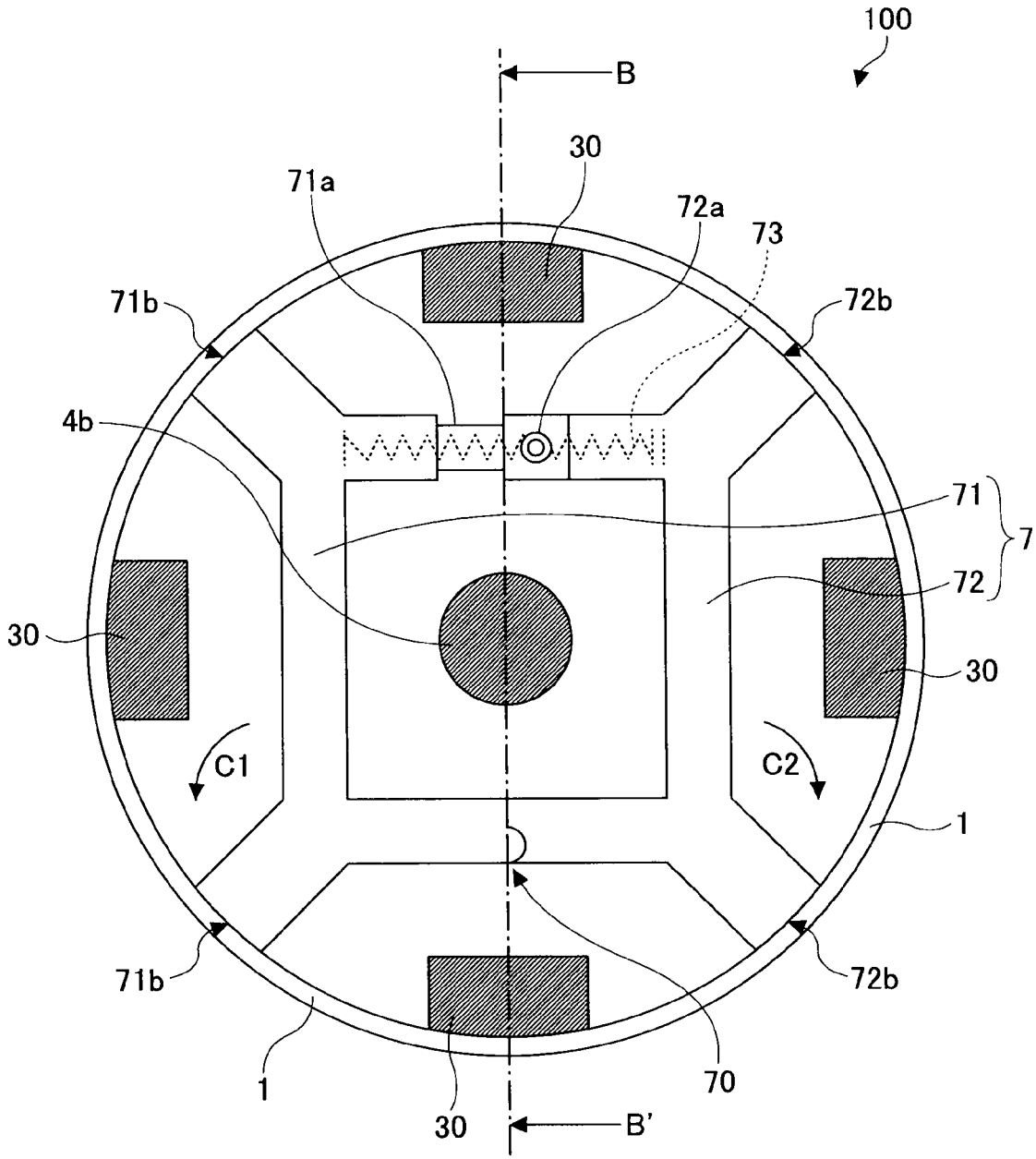
FIG.2 PRIOR ART
FIG. 2 is a cross-sectional view when cut along a vertical plane perpendicular to the center line of the conventional photoconductive drum.
Figure 3A:
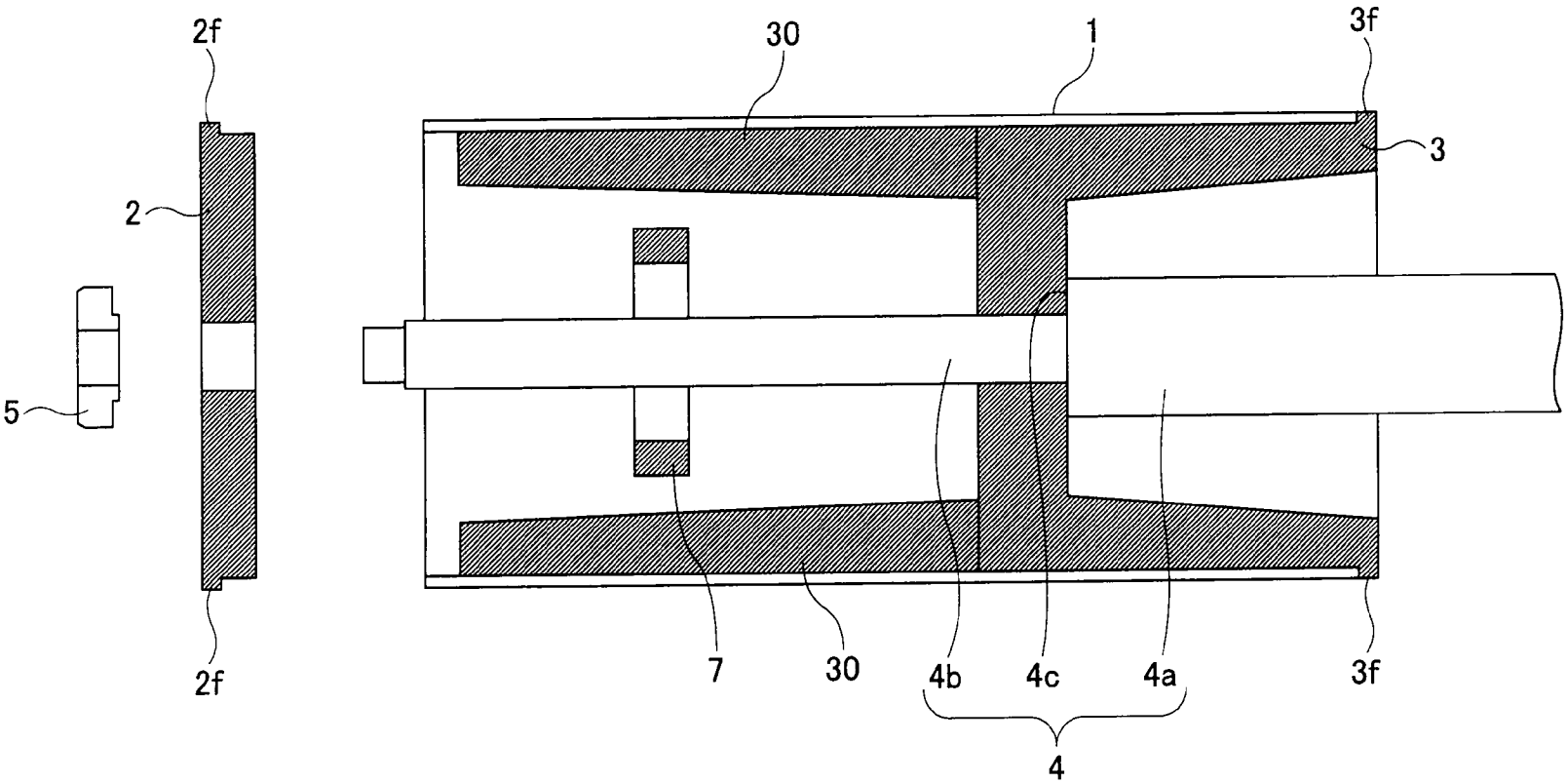
FIG.3A PRIOR ART
FIGS. 3A and 3B are drawings showing a process of attaching and detaching the photoconductive drum to and from an apparatus main body.
Figure 3B:
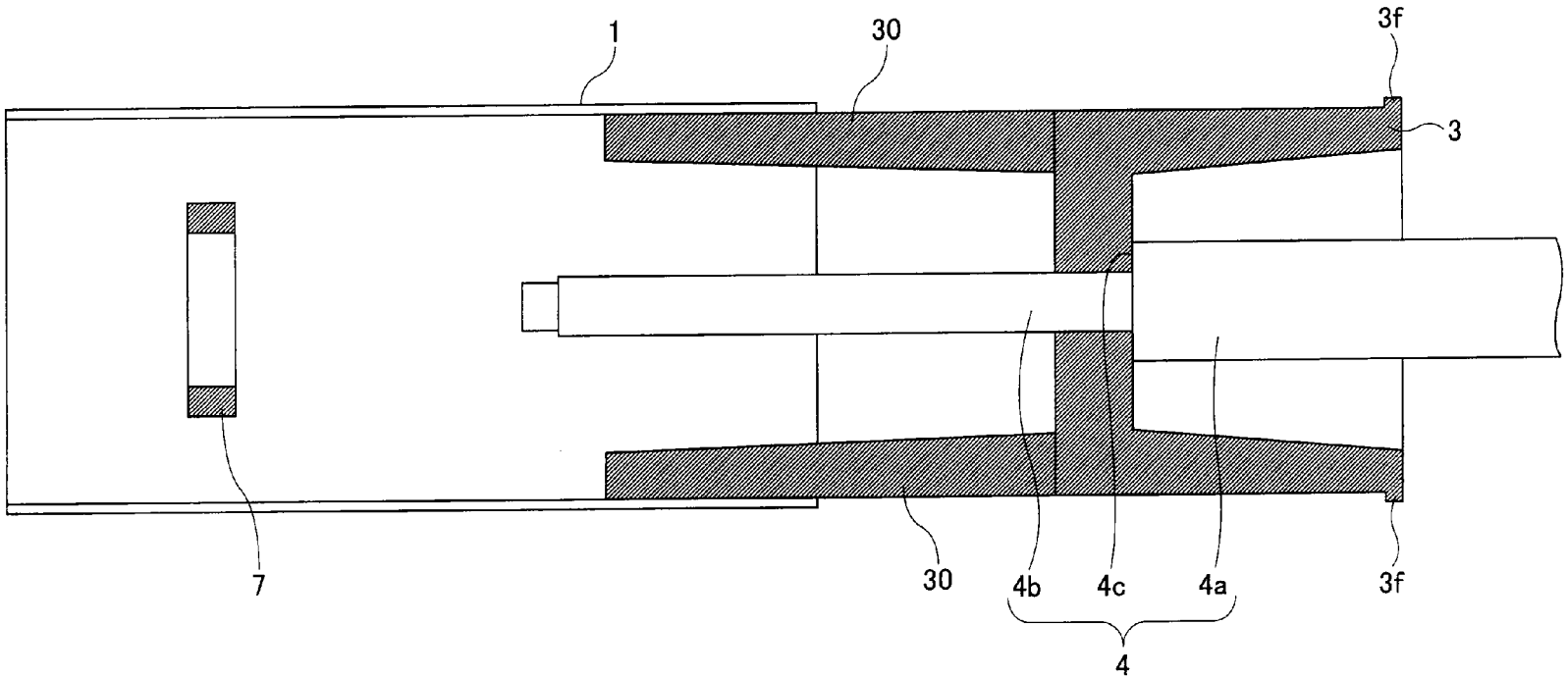
FIG.3B PRIOR ART
Figure 4:
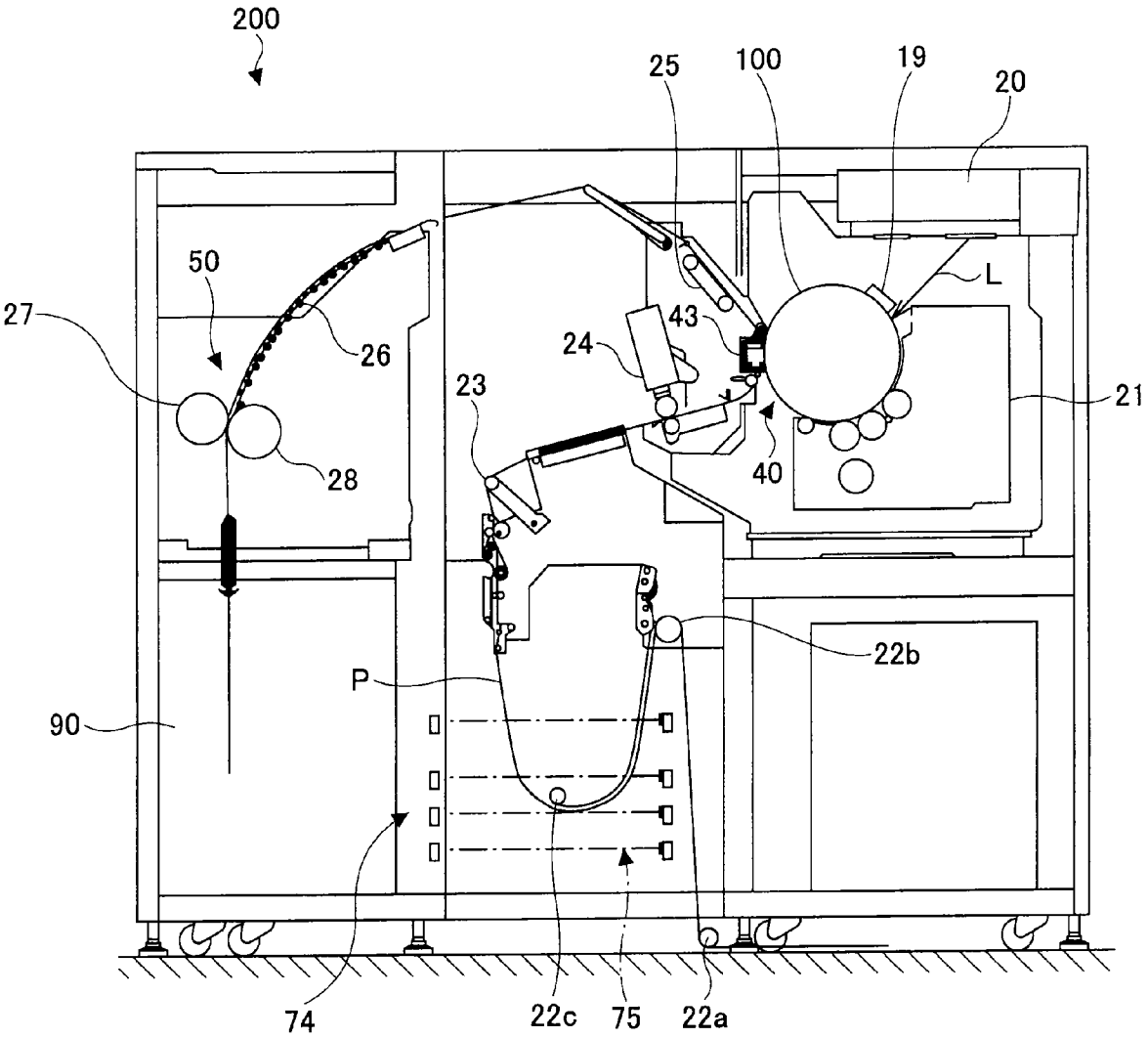
FIG. 4 is a drawing showing an image forming apparatus according to an embodiment of the present invention.

FIG. 4 schematically shows an exemplary configuration of the printer 200 according to an embodiment of the present invention. As shown in FIG. 4, the printer 200 includes a photoconductive drum 100 and a charging device 19, an exposure device 20, a development device 21, and a corona transfer device 43 which are arranged in the circumferential direction along the outer circumferential surface of the photoconductive drum 100, the corona transfer device 43 serving as transfer means.

After charges are uniformly distributed on the surface of the photoconductive drum 100 by the charging device 19, a laser light L in accordance with image data to be printed is irradiated onto the surface of the photoconductive drum 100 by the exposure device 20. By doing this, a static latent image is formed on the surface of the photoconductive drum 100. Then, the static latent image is developed by the development device 21 so that a toner image is formed on the surface of the photoconductive drum 100.

As shown in FIG. 4, the printer 200 further includes a transfer section 40 where the photoconductive drum 100 and the corona transfer device 43 face each other and a web supply device 74 disposed on the upstream side of the feeding direction of the continuous web P which is a recording medium. The web supply device 74 includes a resist device 24, a continuous web tension roller 23, feeding rollers 22*a* through 22*c* and the like. The resist device 24 applies a feeding force to the continuous web P to feed the continuous web P to the transfer section 40 at a predetermined timing. The continuous web tension roller 23 tensions the continuous web P so as not to cause deflection between the continuous web tension roller 23 and the resist device 24. The feeding rollers 22*a* through 22*c* feed the continuous web P in the feeding direction from an accommodating section accommodating the continuous web P to be printed to the continuous web tension roller 23. In the configuration of FIG. 4, as the continuous web P, a roll sheet having no folding lines is used. In this case, as an example, the accommodation section is disposed outside the chassis of the main body of the printer 200. Then the roll sheet (continuous web P) is set in a manner such that the roll sheet is sequentially fed in the order of the accommodation section, under the main body of the printer 200 (as shown in FIG. 4), the first feeding roller 22*a*, the second feeding roller 22*b*, the third feeding roller 22*c*, and the continuous web tension roller 23; and the top of the roll sheet is sandwiched between a pair of the resist rollers of the resist device 24.

On the other hand, when a continuous paper having the holding lines is used as the continuous web P, the continuous paper is accommodated into a Z-shape in an accommodation section 75 disposed inside the printer 200. Then, the top of the continuous paper is sandwiched between the pair of the resist rollers of the resist device 24.

The pair of the resist rollers of the resist device 24 is driven to feed the continuous web P so that a predetermined position of the continuous web P is fed to the position where the toner image formed on the photoconductive drum 100 faces the transfer section 40. The continuous web P may be used for the applications of printing direct mail, invoices, manuals, books and the like. Further, as the applications have expanded, more and more types of papers ranging, for example, from thin paper to thick paper and from high-quality paper to coarse paper have been used as the continuous web. Furthermore, the length in the width direction (i.e., in the front-rear direction in FIG. 4) of the continuous web varies depending on the types of the continuous web. Therefore, when the continuous web used as the continuous web P is replaced by another type of the continuous web, it may be required to adjust the positions of the members (such as feeding rollers 22, continuous web tension roller 23 and the resist device 24) in the web supply device 74 for feeding the continuous web to be fit to the length in the width direction of the new continuous web.

In the transfer section 40, the toner image formed on the surface of the photoconductive drum 100 is transferred to the surface of the continuous web P by the corona transfer device 43. Then, the continuous web P having passed through the transfer section 40 is further fed toward a fixing section 50 by a web feeding device 25.

While the continuous web P fed toward the fixing section 50 passes through a preheating section 26, the toner image transferred to the surface of the continuous web P is heated to the temperature at about the transfer temperature of the toner resin. Then, the continuous web P is further fed to the fixing section 50 including a heat roller 27 having a heater and a backup roller 28. In the fixing section 50, the toner image on the continuous web P is heated and pressed between the heat roller 27 and the backup roller 28 to be melted and adhered to the surface of the continuous web P, thereby fixing the toner image on the continuous web P. The continuous web P having the fixed toner image on the continuous web P is stored in a stack section 90.

Further, in double-sided printing, in the first step, a toner image is transferred and fixed to the front surface (first surface) P1 of the continuous web P as the first printing using the printer 200 described above. Then, in the second step, the continuous web P stored in the stack section 90 is taken out to be set in a manner such that the surface opposite to the surface on which the toner image is transferred and fixed in the first printing becomes the surface on which another toner image is to be transferred and fixed in the second printing. Then, in the second printing, the another toner image is transferred and fixed to the rear surface (second surface) P2 of the continuous web P.

Next, an exemplary configuration of the photoconductive drum 100 applicable to the printer 200 according to an embodiment of the present invention is described with reference to the accompanying drawings.

Figure 5:
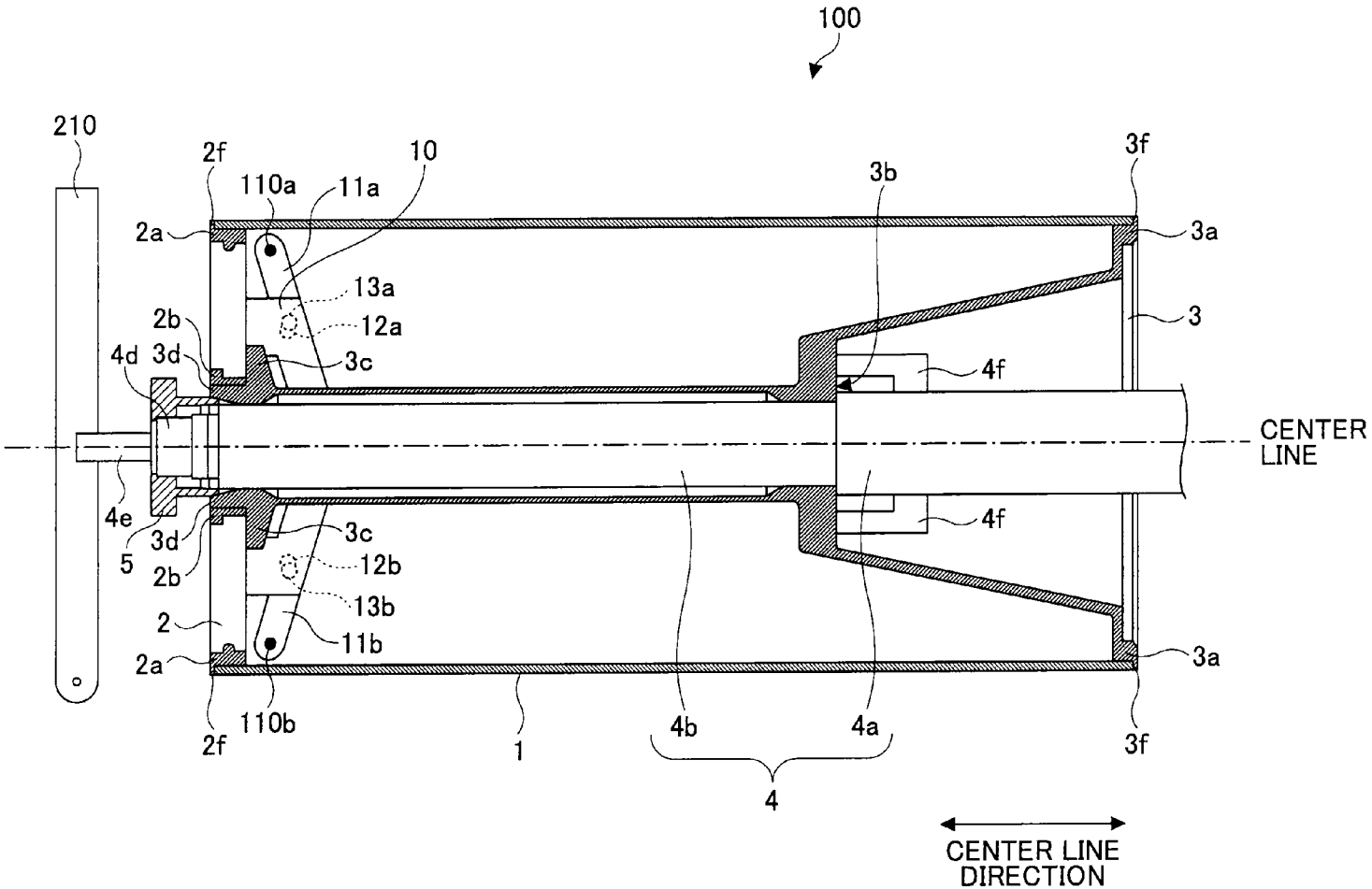
FIG. 5 is a schematic side cross-sectional view showing a photoconductive drum according to an embodiment of the present invention when the photoconductive drum is disposed in the main body of the image forming apparatus.

FIG. 5 is a schematic side cross-sectional view of the photoconductive drum 100 when viewed from the right-hand side of the photoconductive drum 100 disposed in the printer 200 in FIG. 4.

As shown in FIG. 5, the photoconductive drum 100 includes a photoconductive sleeve member 1, a cap member 2 which is a first end surface member, and a wheel member 3 which is a second end surface member. By engaging the photoconductive drum 100 with a driving shaft 4 that transmits rotational drive to the photoconductive sleeve member 1, the photoconductive drum 100 is supported by the main body of the printer 200. Further, by closing a front cover 210 to its closed position shown in FIG. 5, a shaft end section 4*e* of the driving shaft 4 is supported by a shaft bearing (not shown) formed on the front cover 210.

Figure 6:
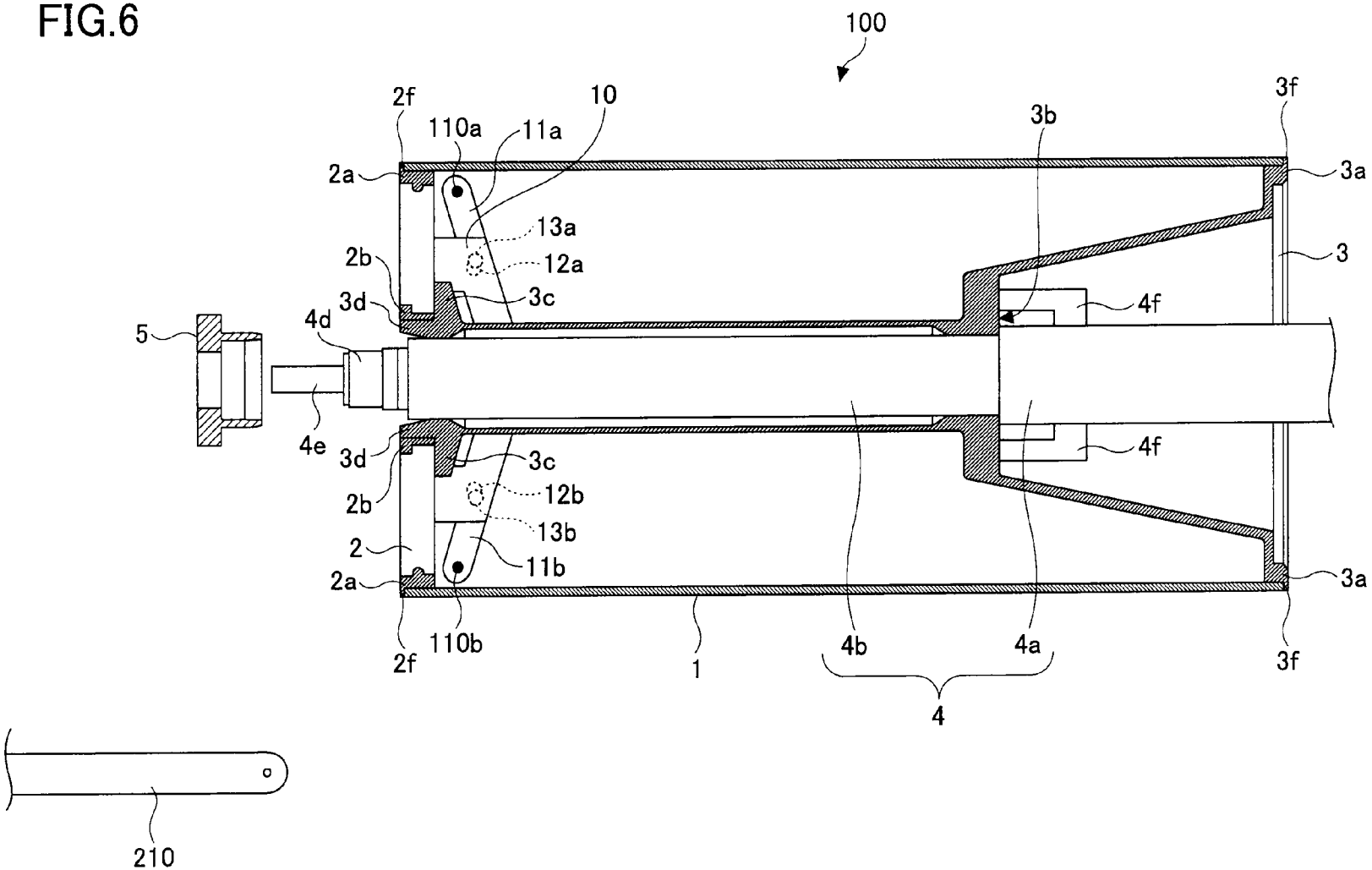
FIG. 6 is a drawing showing where a handle is detached to remove the photoconductive drum from the main body of the image forming apparatus.
Figure 7:
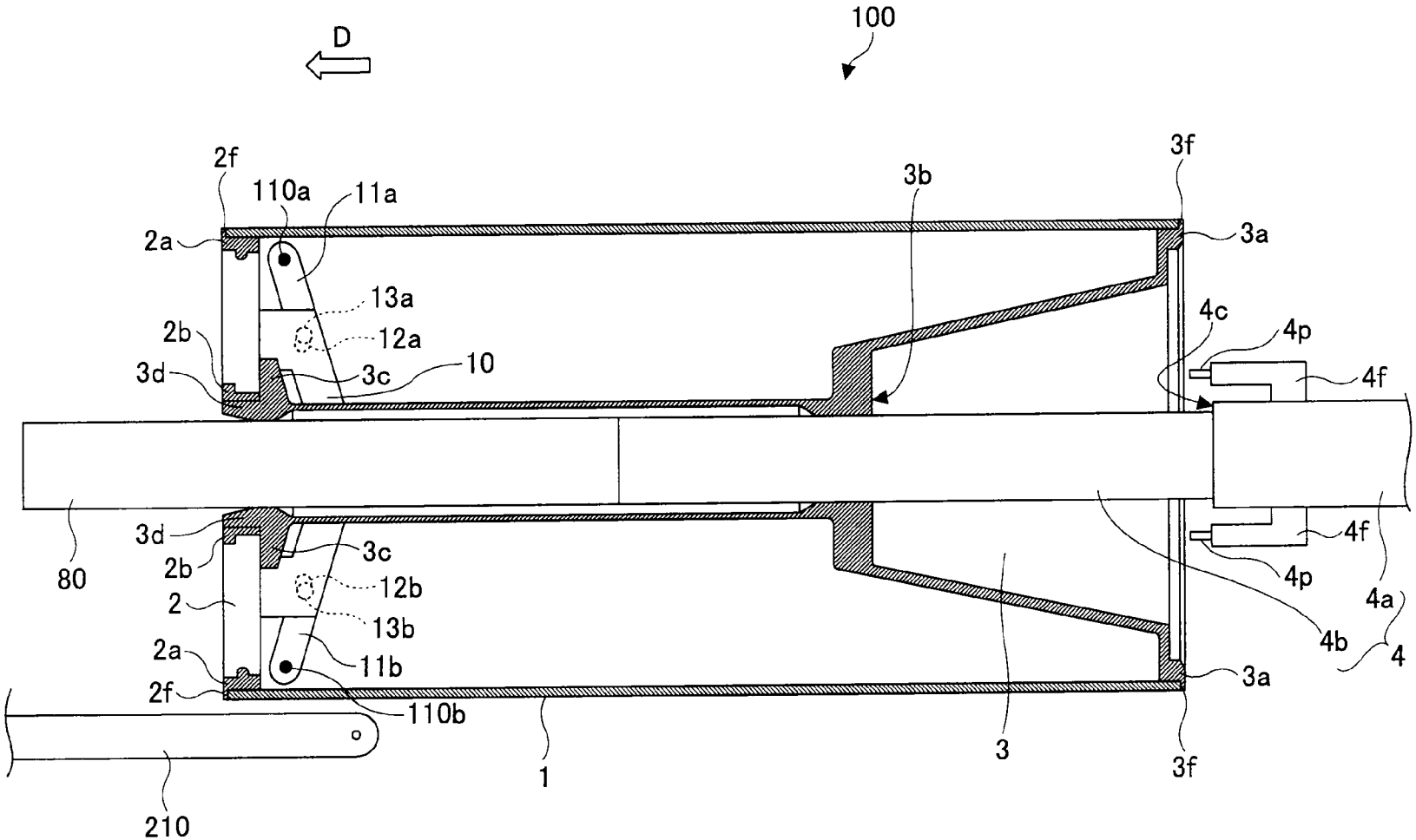
FIG. 7 is a drawing showing where the photoconductive drum is pulled and separated from a driving shaft of the main body of the image forming apparatus.

First, a procedure is described to take out the photoconductive drum 100 from the printer 200. FIGS. 6 and 7 schematically show the procedure to take out the photoconductive drum 100 from the printer 200.

In FIG. 5, when the front cover 210 is open, the state is changed to that in FIG. 6. In FIG. 6, a handle 5 having a female thread formed thereon is loosened with respect to the driving shaft 4 having a male thread section 4*d* formed thereon to remove the handle 5.

Next, as shown in FIG. 7, an extension shaft 80 is engaged with the male thread section 4*d* of the driving shaft 4. Then, by grasping and pulling the cap member 2 in the arrow direction D of FIG. 7, the photoconductive drum 100 can be pulled out from the driving shaft 4 as shown in FIG. 7. By doing this, as shown in FIG. 8, it becomes possible to remove the photoconductive drum 100 including the photoconductive sleeve member 1, the cap member 2, and the wheel member 3 from the main body of the printer 200.

FIGS. 8 through 12B schematically show an exemplary configuration of the photoconductive drum 100 alone.

Figure 8:
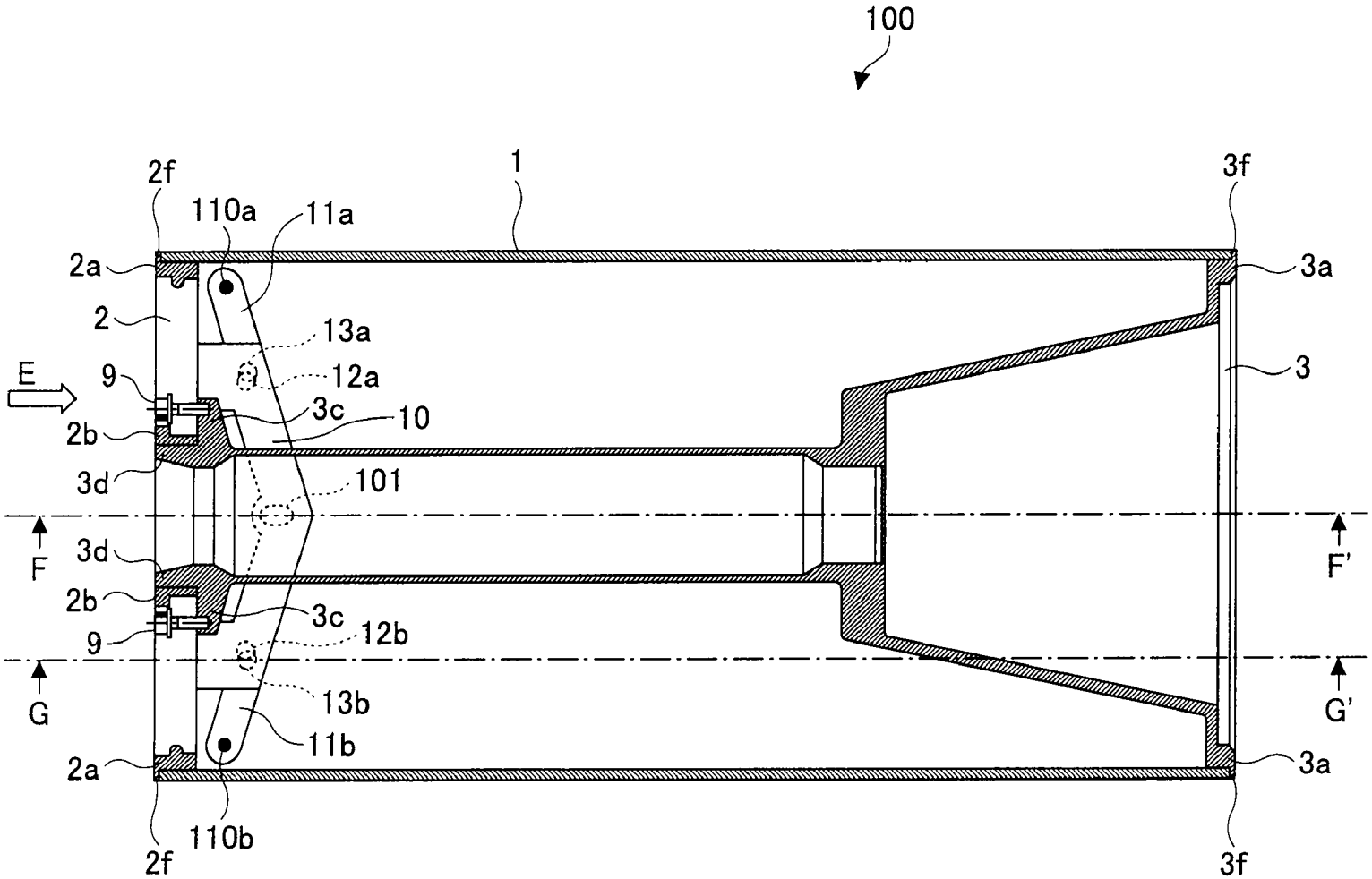
FIG. 8 is a schematic side cross-sectional view of the photoconductive drum according to an embodiment of the present invention.
Figure 9:
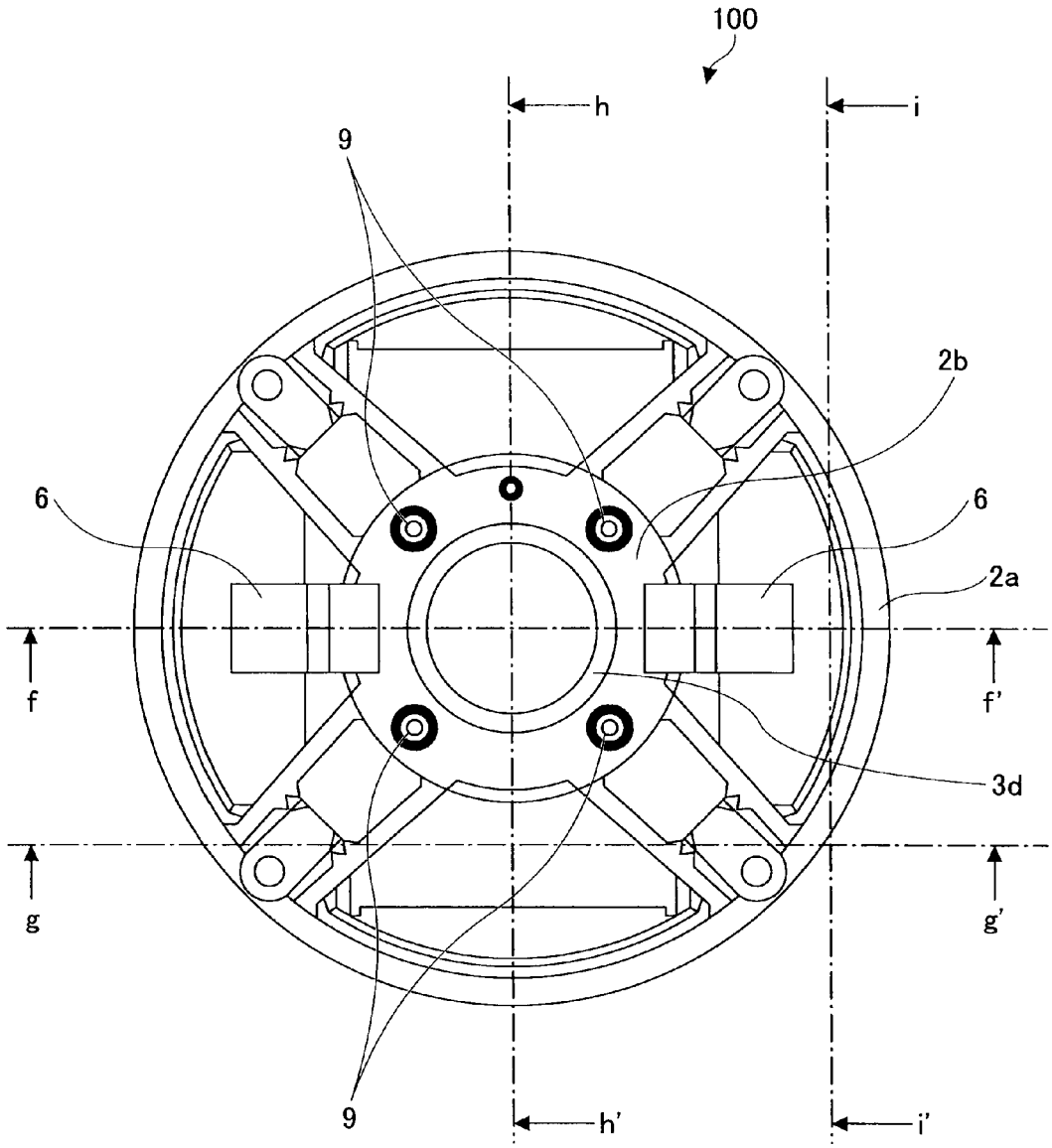
FIG. 9 is a schematic front view of the photoconductive drum according to an embodiment of the present invention.

FIG. 8 is a schematic side cross-sectional view of the photoconductive drum 100 alone when viewed from the same side as in FIG. 5. FIG. 9 is a front view of the photoconductive drum 100 when seen from the arrow direction E in FIG. 8. More specifically, FIG. 8 is a schematic side cross-sectional view of the photoconductive drum 100 when cut along a virtual plane including the center line of the photoconductive drum 100 and line h-h' in FIG. 9. Herein, unless otherwise described, the center line refers to the line passing though the center (rotation center) of the photoconductive sleeve member 1 and extending in the longitudinal direction of the photoconductive sleeve member 1 as shown in FIG. 5.

Further, according to the embodiment of the present invention, the photoconductive drum 100 has a cylindrical shape; and the cap member 2 includes two operation members 6 symmetrically disposed as shown in FIG. 9. The cap member 2 further includes two arm members 11 disposed one on each of right and left sides around the center line (as shown in FIG. 11). The arm members 11 each includes a first arm member 11*a* and a second arm member 11*b* as shown in FIG. 8. It is assumed that, when the first arm members 11*a* are disposed on the top side and the second arm members 11*b* are disposed on the bottom side in the photoconductive drum 100 as shown in FIG. 8, the photoconductive drum 100 is in its normal position. In this description and the accompanying figures, it is assumed that the photoconductive drum 100 is in its normal position and that the side cross-sectional view is the view when seen from one side (right side in FIG. 4) of the photoconductive drum 100 in its normal position and the bottom cross-sectional view is the view when seen from the bottom of the photoconductive drum 100 in its normal position.

In the photoconductive drum 100 according to the embodiment of the present invention, when the photoconductive drum 100 is in its normal position, right and left portions of the photoconductive drum 100 about the center line are symmetrically disposed. However, since the shape of the first arm members 11*a* differs from that of the second arm members 11*b*, top and bottom portions of the photoconductive drum 100 about the center line are not symmetrically disposed.

Figure 10:
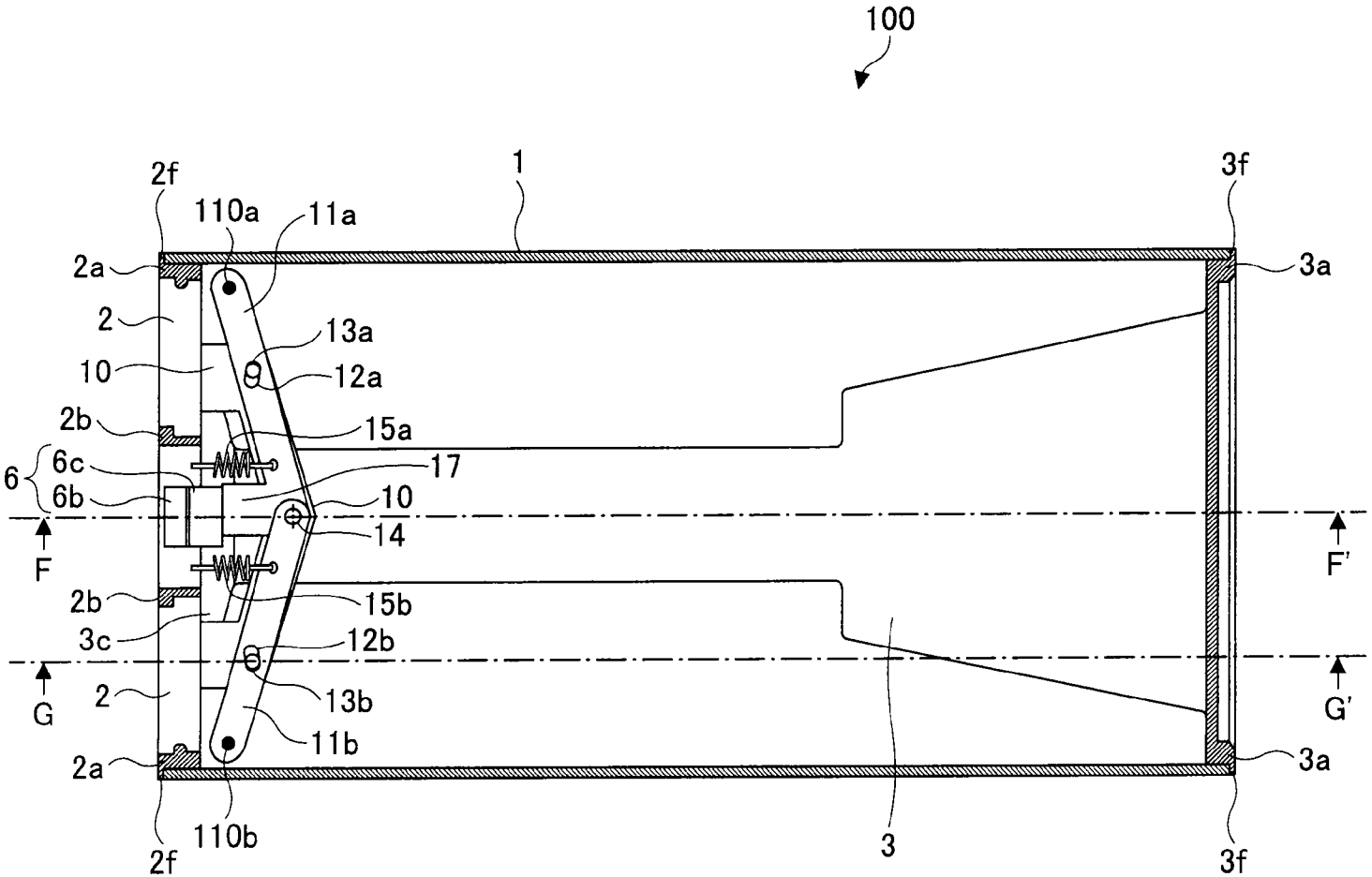
FIG. 10 is a schematic side cross-sectional view of the photoconductive drum according to an embodiment of the present invention when cut along a virtual plane including the line i-i' in FIG. 9.
Figure 11A:
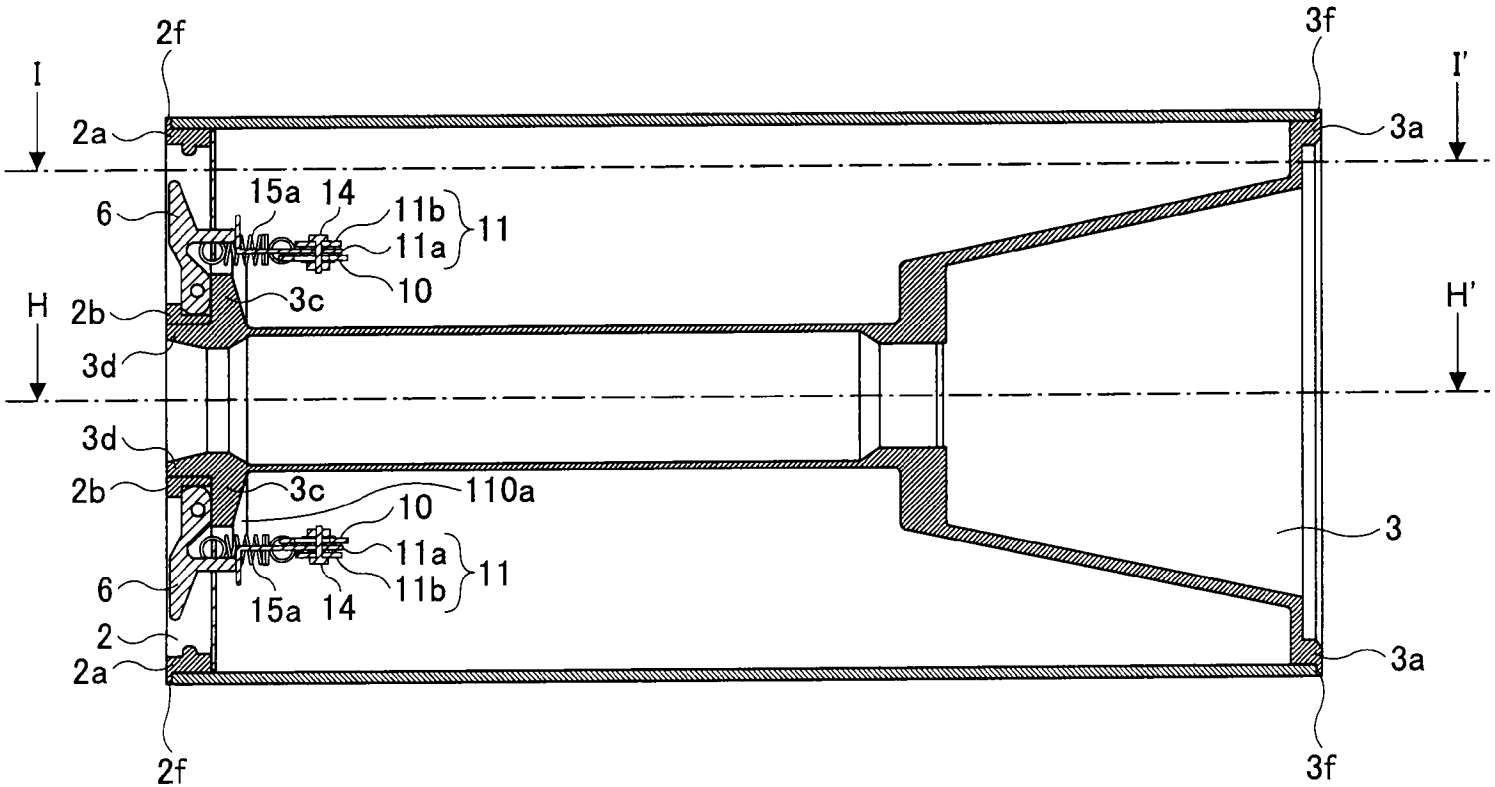
FIG. 11A is a schematic bottom cross-sectional view of the photoconductive drum according to an embodiment of the present invention when cut along a virtual plane including the line f-f' in FIG. 9.
Figure 11B:
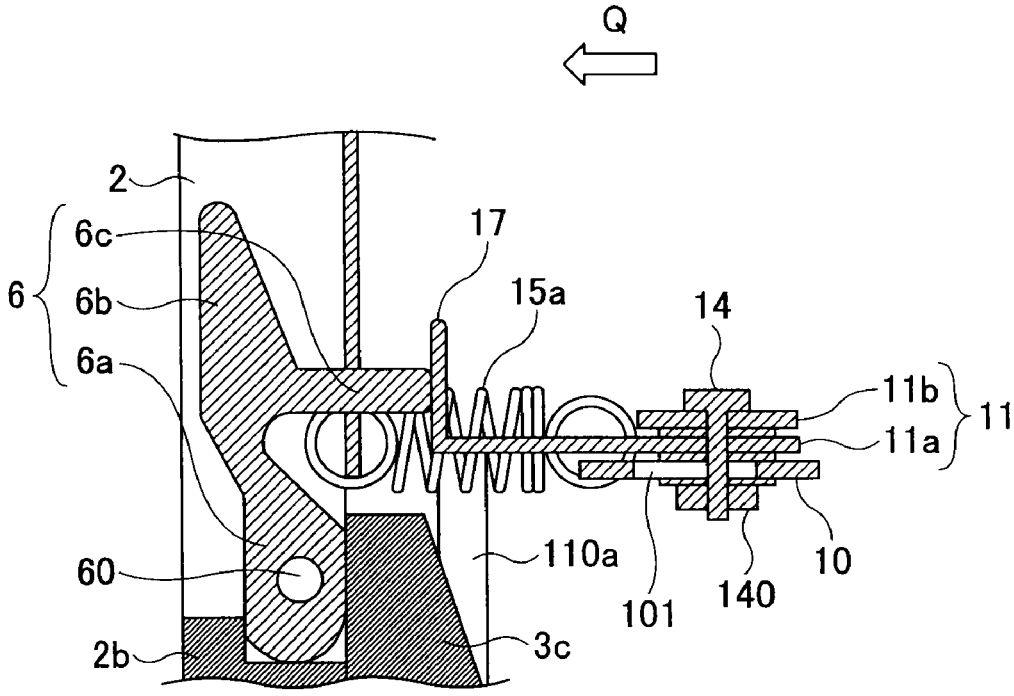
FIG. 11B is an enlarged cross-sectional view of a structure including an operation member and a arm member in FIG. 11A.
Figure 12A:
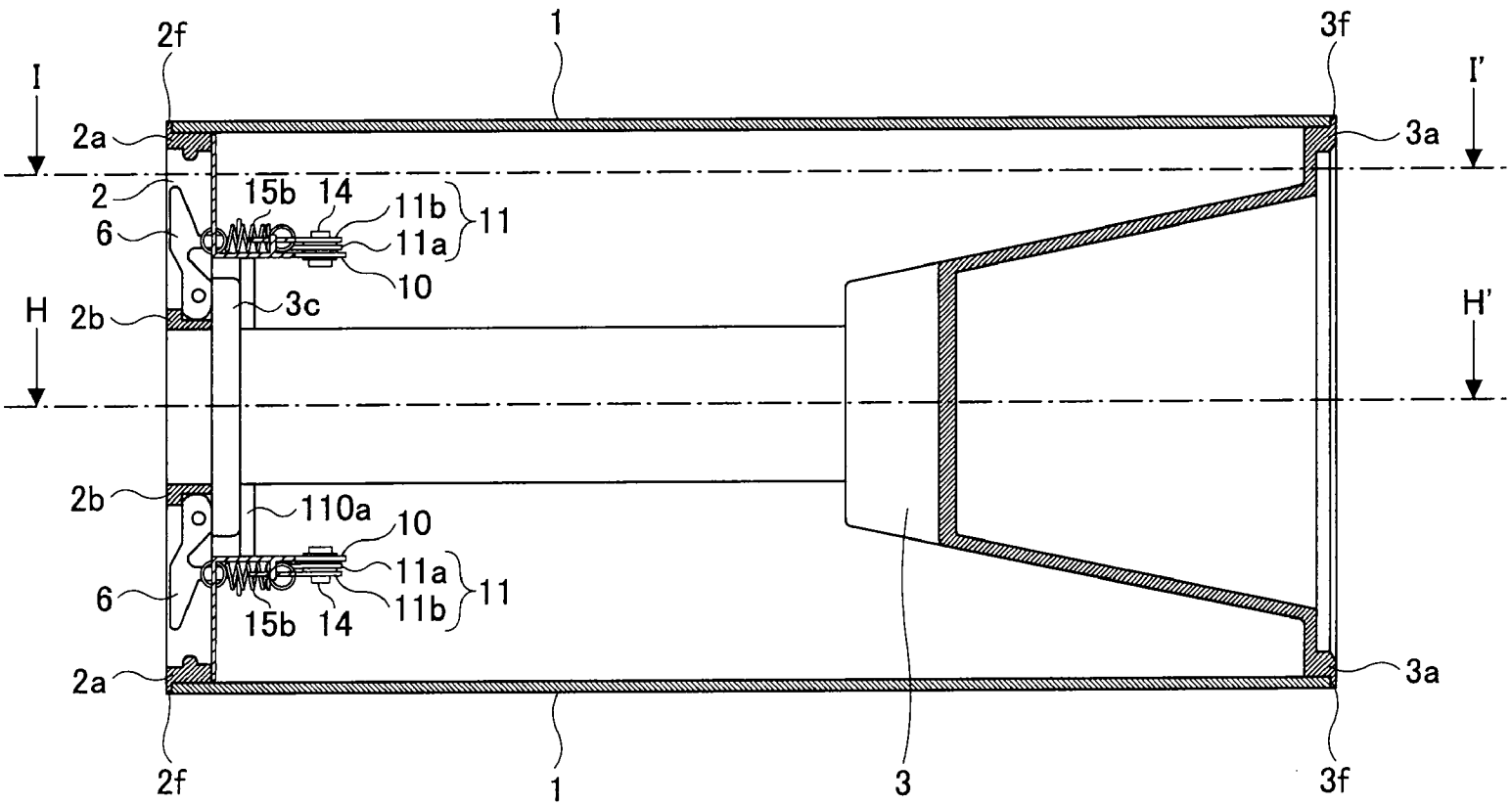
FIG. 12A is a schematic bottom cross-sectional view of the photoconductive drum according to an embodiment of the present invention when cut along a virtual plane including the line g-g' in FIG. 9.
Figure 12B:
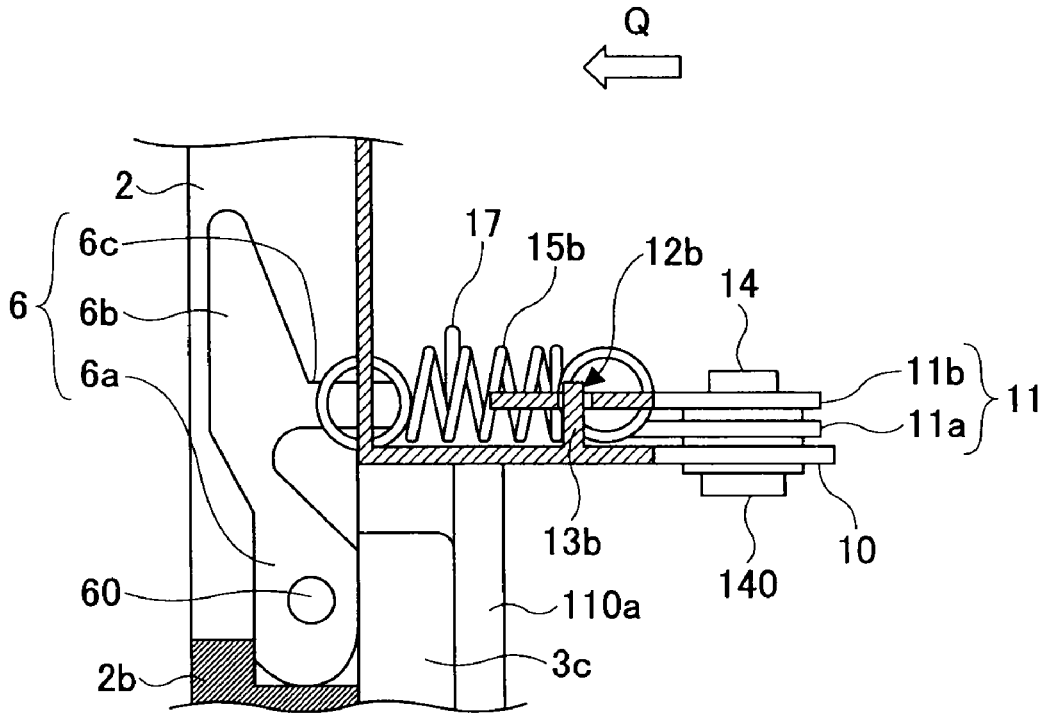
FIG. 12B is an enlarged cross-sectional view of the structure including the operation member and the arm member in FIG. 12A.

FIGS. 10, 11A, and 12A are schematic cross-sectional views of the photoconductive drum 100 when cut along the corresponding virtual planes. However, the virtual planes for those figures are different from the virtual plane for FIG. 8. More specifically, FIG. 10 is a schematic side cross-sectional view of the photoconductive drum 100 when cut along a virtual plane including a line parallel to the center line and line i-i' in FIG. 9. FIG. 11A is a schematic bottom cross-sectional view of the photoconductive drum 100 when cut along a virtual plane including the center line and line f-f' in FIG. 9. FIG. 12A is a schematic bottom cross-sectional view of the photoconductive drum 100 when cut along a virtual plane including a line parallel to the center line and line g-g' in FIG. 9. Further, FIGS. 11A and 12A are schematic bottom cross-sectional view of the entire photoconductive drum 100 based on the corresponding virtual planes. FIGS. 11B and 12B are enlarged cross-sectional views of the corresponding structures including the operation member 6 and the arm member 11 in FIGS. 11A and 12A, respectively.

Further, FIG. 8 is a schematic side cross-sectional view of the photoconductive drum 100 when cut along the vertical plane including line H-H' in FIGS. 11A and 12A. FIG. 10 is a schematic side cross-sectional view of the photoconductive drum 100 when cut along the vertical plane including line I-I' in FIGS. 11A and 12A. FIG. 11A is a schematic bottom cross-sectional view of the photoconductive drum 100 when cut along the horizontal plane including line F-F' in FIGS. 8 and 10. FIG. 12A is a schematic bottom cross-sectional view of the photoconductive drum 100 when cut along the horizontal plane including line G-G' in FIGS. 8 and 10. The vertical/horizontal plane herein refers to a virtual plane extending in the vertical/horizontal direction, assuming that the photoconductive drum 100 is in its normal position.

When it is assumed that a cross-sectional view of a member having a cylindrical or conical shape when cut along a virtual plane including a line parallel to the center line of the member shows only the part of member displaced on the virtual plane, the cross-sectional views differ depending on the position of the virtual planes. For example, as far as the side cross-sectional view is concerned, a case is considered where there is provided the side cross-sectional view when cut along the virtual (vertical) plane including the line h-h' in FIG. 9. In this case, the length in the height direction of the photoconductive drum 100 in the virtual plane is maximized; therefore, the side cross-sectional view as shown in FIG. 8 is obtained. Now, another case is considered where there is provided the side cross-sectional view when cut along the virtual (vertical) plane including the line i-i' in FIG. 9. In this case, the length in the height direction of the photoconductive drum 100 in the virtual plane is less than that in the above case where the virtual (vertical) plane including the line h-h' in FIG. 9. Therefore, in this case, if the side cross-sectional view includes only the part present on the virtual plane, the side cross-sectional view shows only limited parts such as photoconductive sleeve member 1 and does not include parts such as the operation members 6 and the arm members 11. Therefore, if the general method of showing the cross-sectional view as described above is adopted in this description, it may become difficult to adequately describe the members displaced near the center portion of photoconductive drum 100. Therefore, to avoid the inconvenience, in the cross-sectional views in the figures of this description, it is assumed that the members having a cylindrical or conical shape (i.e., the photoconductive sleeve member 1, the cap member 2, and the wheel member 3) are shown in a manner such as the corresponding shapes of the members on the virtual plane including the center line of the photoconductive sleeve member 1 are shown. Further, the other members are shown in a manner such that the shapes of the members shown from the virtual plane are shown.

Next, a procedure to replace the photoconductive sleeve member 1 is described.

Figure 13:
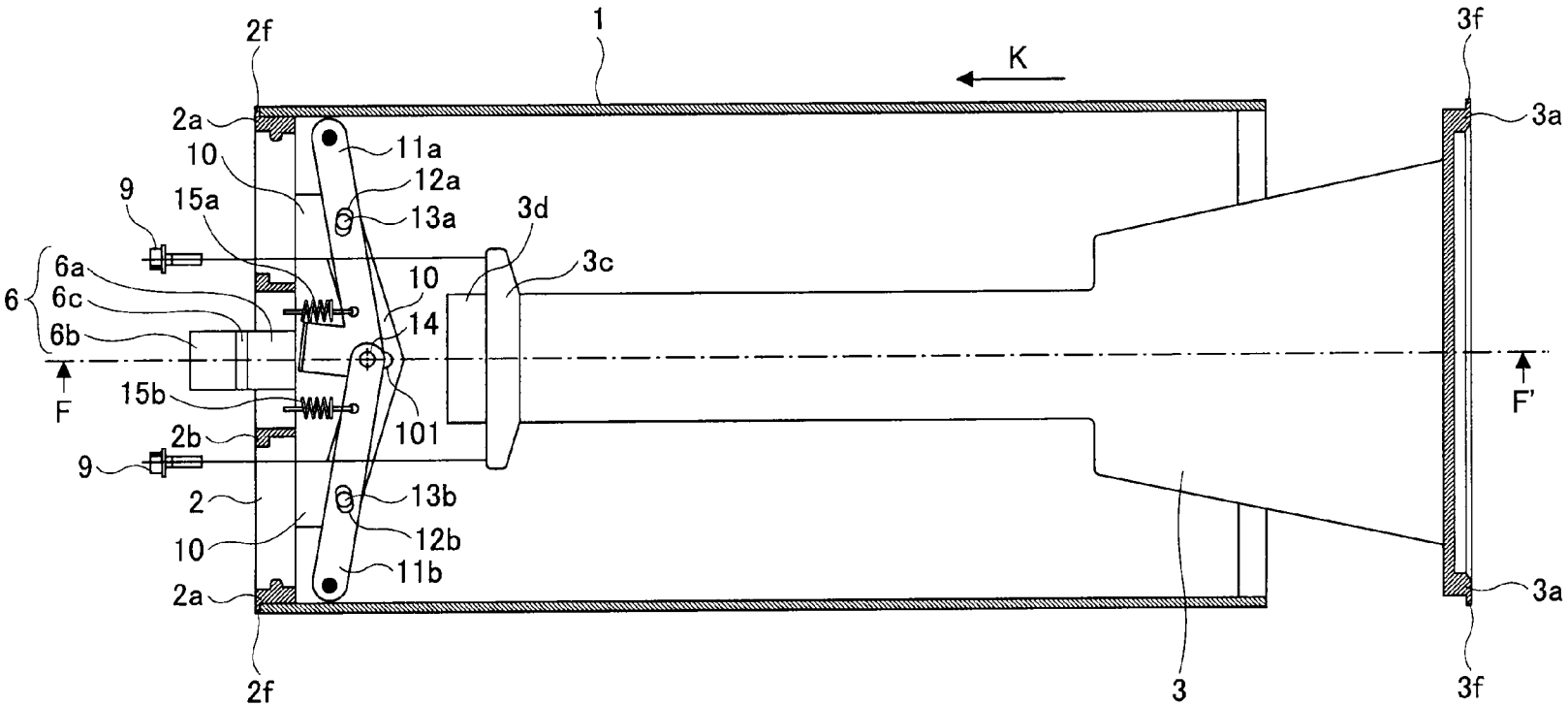
FIG. 13 is a schematic side cross-sectional view of the photoconductive drum according to an embodiment of the present invention when cut along a virtual plane including the line i-i' in FIG. 9 in a case where the photoconductive drum is to be removed from a wheel member.

Before the photoconductive drum 100 is removed from the printer 200, the photoconductive drum 100 is in the status as shown in FIGS. 8 through 12B. To remove the photoconductive drum 100 from the printer 200, first, as shown in FIG. 13 (a side cross-sectional view based on the same virtual (vertical) plane as used for FIG. 10), hexagon socket bolts 9 are removed from their positions. Then, operation lever sections 6*b* of the operation members 6 in the cap member 2 are pulled outward in the center line direction (i.e., in the arrow direction Q in FIG. 12B) to be set to the positions as shown in FIGS. 14A and 14B.

Figure 14A:
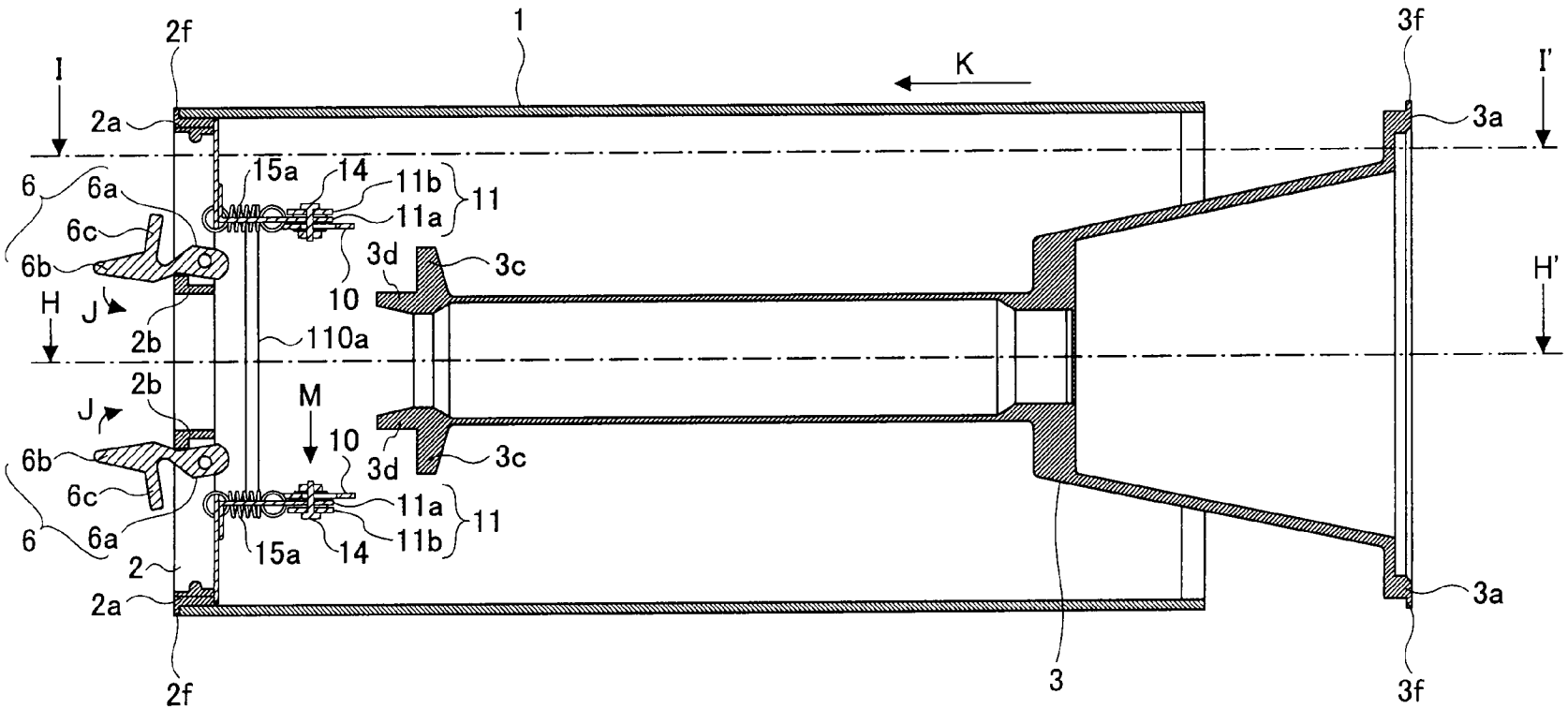
FIG. 14A is a schematic bottom cross-sectional view of the photoconductive drum according to an embodiment of the present invention when cut along a virtual plane including the line f-f' in FIG. 9 in the case where the photoconductive drum is to be removed from the wheel member.

FIG. 14A is a schematic bottom cross-sectional view of the photoconductive drum 100 when cut along the horizontal plane including line F-F' in FIG. 13. Further, FIG. 14A is a cross-sectional view showing the entire photoconductive drum 100 on the horizontal plane. On the other hand, FIG. 14B is an enlarged cross-sectional view of the structure including one of the operation members 6 and one of the arm members 11 in FIG. 14A. Details of the operation members 6 and the arm members 11 are described below.

Figure 14B:
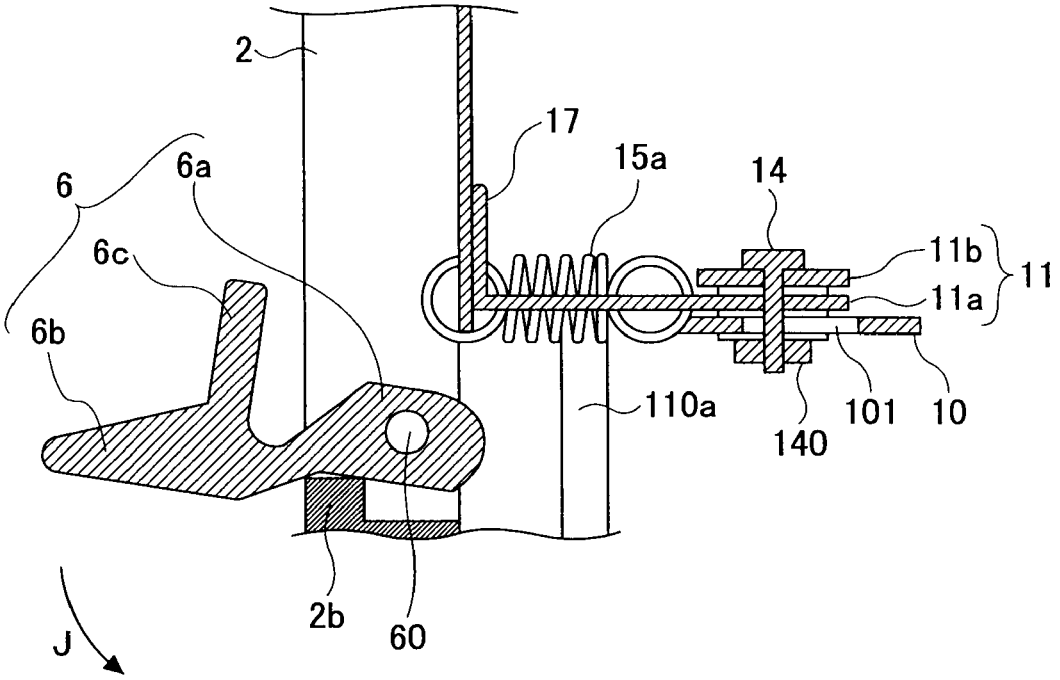
FIG. 14B is an enlarged cross-sectional view of the structure including the operation member and the arm member in FIG. 14A.

When the operation lever sections 6*b* of the operation members 6 in the cap member 2 are pulled outward in the center line direction as described above, the operation lever sections 6*b* rotate in the arrow direction J in FIG. 14A about the respective operations axes 60 (as shown in FIG. 14B). The details are described below, but by operating the operation members 6 in this way, ends of the arm members 11 (11*a* and 11*b* in FIG. 13) are in contact with the inner circumferential surface of the photoconductive sleeve member 1 to press the inner circumferential surface due to the elastic force of spring members 15 (15*a* and 15*b* in FIG. 13) which are biasing members. By doing this, the cap member 2 is engaged with the photoconductive sleeve member 1.

Further, at the same time when the operation members 6 are operated as described above, eccentric cam sections 6*a* of the operation members 6 are also rotated. Due to the rotation of the eccentric cam sections 6*a*, flange sections 3*c* on the cap member side of the wheel member 3 are pressed inward in the center line direction (i.e., in the direction opposite to the arrow direction Q in FIG. 12B), so that a force is applied to separate the cap member 2 from the wheel member 3. As a result, by operating the operation members 6 as described above, the photoconductive sleeve member 1 and the cap member 2 can be integrally separated from the wheel member 3. Then, while the wheel member 3 is fixed to its position, by pulling out the cap member 2 in the arrow direction K in FIGS. 13 and 14A, the photoconductive sleeve member 1 and the cap member 2 can be integrally taken out (removed) from the wheel member 3. Further, the member causing the arm member 11 to apply the biasing force to press the inner circumferential surface of the photoconductive sleeve member 1 is not limited to the spiral spring member 15. For example, any other elastic member such as a plate spring or the like may be alternatively used as long as the cap member 2 can be fixed in position with respect to the photoconductive sleeve member 1 by the elastic member.

Figure 15A:
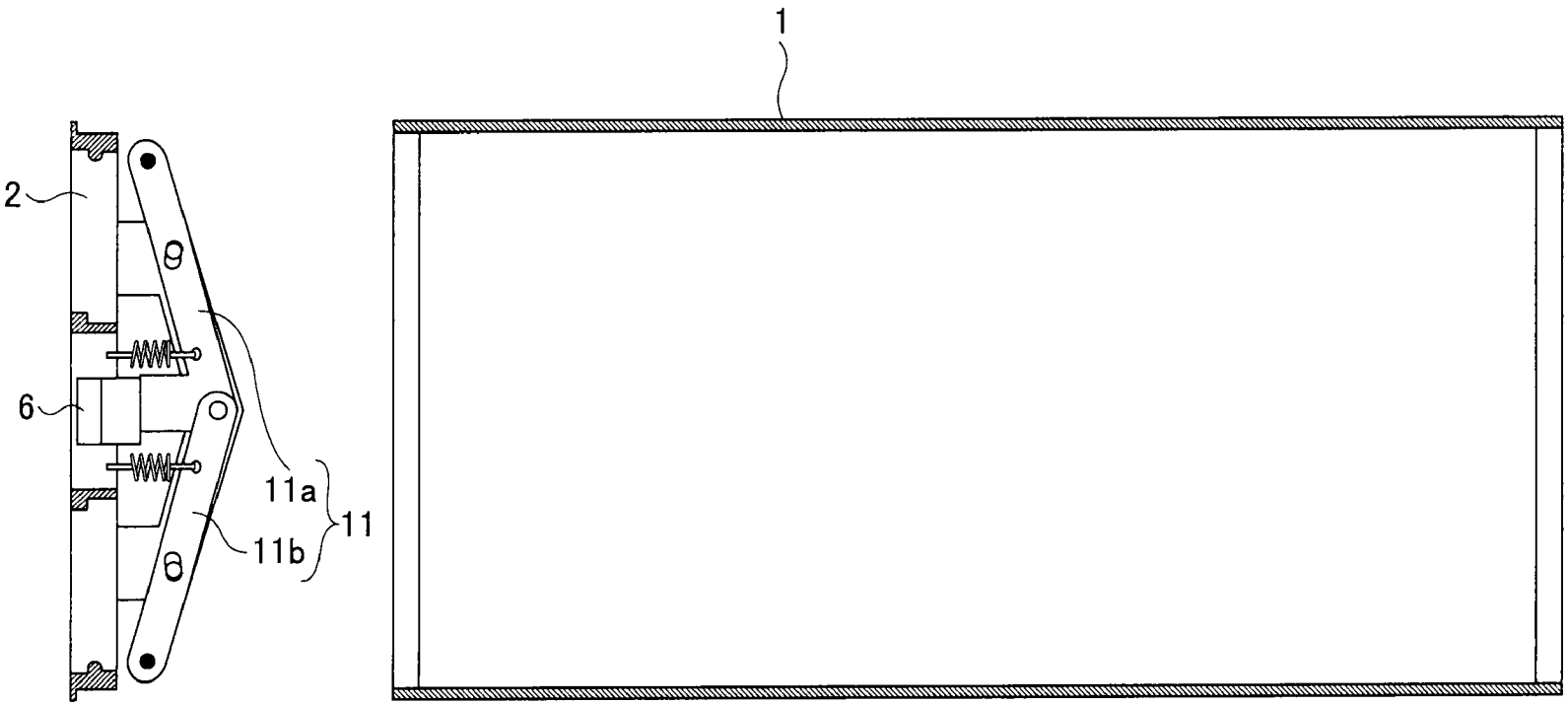
FIG. 15A is a schematic side cross-sectional view showing where a first end surface member (cap member) is removed from the photoconductive drum.
Figure 15B:
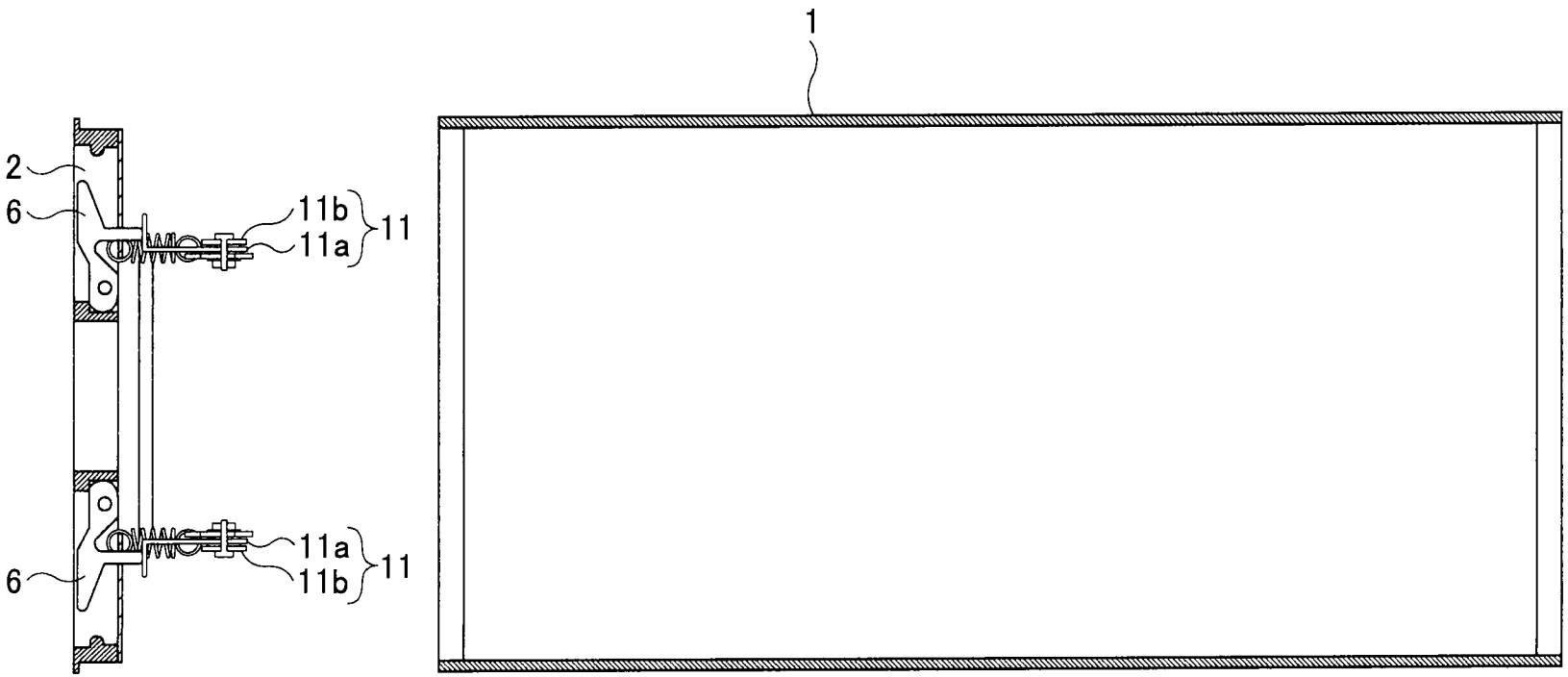
FIG. 15B is a schematic bottom cross-sectional view showing where the first end surface member (cap member) is removed from the photoconductive drum.

Next, the operation members 6 are rotated in the direction opposite to the arrow direction J in FIG. 14A to set the operation members 6 in their original positions (as shown in FIGS. 8 through 12B). By doing this, the ends of the arm members 11 (11*a* and 11*b* in FIG. 13) can be separated from the inner circumferential surface of the photoconductive sleeve member 1. Therefore, the pressing on the inner circumferential surface of the photoconductive sleeve member 1 by the arm members 11 is released; in other words, the engagement between the cap member 2 and the photoconductive sleeve member 1 is released. As a result, the cap member 2 becomes detachable from the photoconductive sleeve member 1. In this state, an operator inserts a hand or a tool through an opening on the side where the photoconductive sleeve member 1 is engaged with the wheel member 3 and holds the photoconductive sleeve member 1 in its position. Then, the operator grasps the cap member 2 and pulls the cap member 2 in the direction to separate the cap member 2 from the photoconductive sleeve member 1 (i.e., outward in the center line direction). By pulling the cap member 2 in this way, the photoconductive sleeve member 1 and the cap member 2 can be separated from each other, thereby enabling collecting only the used photoconductive sleeve member 1 to be replaced as shown in FIGS. 15A and 15B. FIG. 15A is a schematic side cross-sectional view when cut along the same vertical plane as that for FIG. 13. On the other hand, FIG. 15B is a schematic bottom cross-sectional view when cut along the same horizontal plane as that for FIG. 14A.

Then, the used photoconductive sleeve member 1 is replaced by a new photoconductive sleeve member 1. The new photoconductive sleeve member 1 is retained in position between the cap member 2 and the wheel member 3 by performing the procedure opposite to that for removing the photoconductive sleeve member 1 as described above to form a new photoconductive drum 100. The new photoconductive drum 100 is attached to the driving shaft 4 and the front cover 210 is closed, so that the replacement operation of the photoconductive sleeve member 1 is completed. By doing as described above, it may become possible to replace the photoconductive sleeve member 1 without touching the surface of the photoconductive sleeve member 1 with a hand or tool.

According to the embodiment of the present invention, the photoconductive drum 100 can be attached to the driving shaft 4 in the state where the cap member 2 and the wheel member 3 are engaged with the photoconductive sleeve member 1 and where the engagement between the arm members 11 and the photoconductive sleeve member 1 is released. The driving shaft 4 is the driving axis for driving the photoconductive body of the printer 200.

Next, the details of the photoconductive drum 100 according to the embodiment of the present invention are described.

As shown in FIG. 5, the shape of the photoconductive sleeve member 1 of the photoconductive drum 100 is hollow cylindrical. Further, as shown in FIG. 5, one end section of the inner circumferential surface of the photoconductive sleeve member 1 in the center line direction can be in contact with and engaged with the outer circumferential surface of a cap-member outer circumferential section 2*a* of the cap member 2. Similarly, the other end section of the inner circumferential surface of the photoconductive sleeve member 1 in the center line direction can be in contact with and engaged with the outer circumferential surface of a wheel-member outer circumferential section 3*a* of the wheel member 3.

To integrate the cap member 2 with the photoconductive sleeve member 1, first, the outer circumferential surface of a cap-member outer circumferential section 2*a* of the cap member 2 is engaged with one end section of the inner circumferential surface of the photoconductive sleeve member 1 in the center line direction. Next, the operation members 6 are operated (rotated in the arrow direction J in FIG. 14A) so that the operation lever sections 6*b* protrude beyond an outer end surface of the cap member 2 in the center line direction as shown in FIGS. 14A and 14B. By doing this, as described above, the arm members 11 are in engaged with the inner circumferential surface of the photoconductive sleeve member 1, so that the cap member 2 can be integrated with the photoconductive sleeve member 1. Then, as shown in FIG. 14A, a cap-member-side end section 3*d* of the wheel member 3 is inserted through an opening on the other side of the photoconductive sleeve member 1 in the center line direction. The wheel member 3 is further inserted in the photoconductive sleeve member 1 until the cap-member-side flange section 3*c* of the wheel member 3 comes into contact with the eccentric cam sections 6*a*. When the cap-member-side flange section 3*c* of the wheel member 3 comes into contact with the eccentric cam sections 6*a*, the inner circumferential surface of a cap-member inner circumferential section 2*b* of the cap member 2 is in contact with the outer circumferential surface of the cap-member-side end section 3*d* of the wheel member 3 and the other end section of the inner circumferential surface of the photoconductive sleeve member 1 in the center line direction is also engaged with the outer circumferential surface of the wheel-member outer circumferential section 3*a* of the wheel member 3. Next, the operation members 6 are operated (rotated in the direction opposite to the arrow direction J in FIG. 14A) so that the longitudinal direction of the operation lever sections 6*b* is disposed along the outer end surface as shown in FIGS. 12A and 12B. By doing this, the protrusions formed by the eccentric cam sections 6*a* with respect to the cap-member-side flange section 3*c* of the wheel member 3 are released, so that the cap member 2 and the wheel member 3 are pressed from both end sides in the center line direction of the photoconductive sleeve member 1. By doing this, the cap member 2 and the wheel member 3 are engaged with the photoconductive sleeve member 1 in a manner such that one end section of the inner circumferential surface of the photoconductive sleeve member 1 in the center line direction is in contact with and engaged with the outer circumferential surface of a cap-member outer circumferential section 2*a* of the cap member 2 and, similarly, the other end section of the inner circumferential surface of the photoconductive sleeve member 1 in the center line direction is in contact with and engaged with the outer circumferential surface of a wheel-member outer circumferential section 3*a* of the wheel member 3.

In this case, the cap member 2 and the wheel member 3 are engaged with each other in a manner such that the inner circumferential surface of the cap-member inner circumferential section 2*b* of the cap member 2 is in contact with the outer circumferential surface of the cap-member-side end section 3*d* of the wheel member 3.

Further, as shown in FIG. 8, after the cap member 2 and the wheel member 3 are engaged with the photoconductive sleeve member 1, the hexagon socket bolts 9 are inserted through the cap-member inner circumferential section 2*b* of the cap member 2 and the cap-member-side flange section 3*c* of the wheel member 3. By doing this, the cap member 2 is fixed in position with respect to the wheel member 3. By using (tightening) the hexagon socket bolts 9, a force can be applied in a manner such that the distance between the cap member 2 and the wheel member 3 in the center line direction is reduced. By doing this, one end section of the inner circumferential surface of the photoconductive sleeve member 1 in the center line direction comes into contact with a cap flange section 2*f* of the cap-member outer circumferential section 2*a* and similarly, the other end section of the inner circumferential surface of the photoconductive sleeve member 1 in the center line direction comes into contact with a wheel flange section 3*f* of the wheel-member outer circumferential section 3*a*, so that the photoconductive sleeve member 1 is retained in position between the cap member 2 and the wheel member 3. By retaining the photoconductive sleeve member 1 in position between the cap member 2 and the wheel member 3, the position of the photoconductive sleeve member 1 with respect to the wheel member 3 may be fixed (determined) and the photoconductive drum 100 capable of being removably attached to the main body of the printer 200 may be provided.

When the photoconductive drum 100 is to be attached to the main body of the printer 200, as shown in FIG. 7, the extension shaft 80 is inserted into the opening at the center of the wheel member 3. Then, the photoconductive drum 100 is slid along the driving shaft 4 in the direction opposite to the arrow direction D in FIG. 7. By sliding this way, a contact surface 3*b* of the wheel member 3 is in contact with the stepping part 4*c* formed between a small diameter part 4*b* and a large diameter part 4*a* of the driving shaft 4. Next, as shown in FIG. 6, the handle 5 is screwed to be engaged with the male thread section 4*d* of the driving shaft 4 until the handle 5 comes into contact with the cap-member-side end section 3*d* of the wheel member 3. As described above, due to the engagement between the contact surface 3*b* of the wheel member 3 and the stepping part 4*c* of the driving shaft 4 and the engagement between the handle 5 and the cap-member-side end section 3*d* of the wheel member 3, the position of the wheel member 3 with respect to the driving shaft 4 in the center line direction is fixed (determined). Further, as shown in FIG. 7, there are provided position determination frames 4*f* formed from one end section of the large diameter part 4*a*, each position determination frame 4*f* having a position determination pin 4*p* formed from the distal end of the position determination frame 4*f*. By having this configuration, when the photoconductive drum 100 is slid along the driving shaft 4 so that the contact surface 3*b* of the wheel member 3 comes into contact with the stepping part 4*c* of the driving shaft 4, the position determination pins 4*p* are engaged with the respective engage holes (not shown) formed on the contact surface 3*b* of the wheel member 3. Due to the engagement between the position determination pins 4*p* and the respective engage holes on the contact surface 3*b*, the position of the wheel member 3 with respect to the driving shaft 4 in the rotational direction of the driving shaft 4 can be fixed (determined). As described above, by fixing the position of the wheel member 3 with respect to the driving shaft 4 in the center line direction and the rotational direction, the position of the photoconductive sleeve member 1 with respect to the driving shaft 4 is accordingly fixed (determined) since the position of the wheel member 3 with respect to the photoconductive sleeve member 1 is fixed. Because of this feature, the photoconductive sleeve member 1 rotates in accordance with the rotation of the driving shaft 4.

Further, as described above, the driving shaft 4 is supported with respect to the main body of the printer 200 by shaft bearings (not shown) provided on both end sides of the driving shaft 4 in the center line direction.

Further, when the photoconductive drum 100 is being fixed in position with respect to the driving shaft 4, as shown in FIGS. 5 and 6, due to the contact between the inner circumferential surface of the cap-member-side end section 3*d* of the wheel member 3 and the small diameter part 4*b* of the driving shaft 4 and the contact between the outer circumferential surface of the cap-member-side end section 3*d* of the wheel member 3 and the inner circumferential surface of the cap-member inner circumferential section 2*b* of the cap member 2, the center of the cylindrical photoconductive sleeve member 1 on the side of the cap member 2 is determined to be the same as the rotational center of the driving shaft 4. On the other hand, due to the contact between the inner circumferential surface of the part forming the contact surface 3*b* of the wheel member 3 and the small diameter part 4*b* of the driving shaft 4, the center of the cylindrical photoconductive sleeve member 1 on the side of the wheel member 3 is determined to be the same as the rotational center of the driving shaft 4.

Next, more details are described how the arm members 11 are in contact with and press the inner circumferential surface of the photoconductive sleeve member 1 when the operation members 6 are operated.

The arm member 11 includes the first arm member 11*a* and the second arm member 11*b*. As shown in FIG. 10, the first arm member 11*a* and the second arm member 11*b* are rotatably connected with each other by a hinge member 14. Further, as shown in FIG. 11A, there is provided a first-arm reinforcement shaft 110*a* connected between two end sections of the first arm members 11*a* symmetrically provided with respect to the center line, the end sections of the first arm members 11*a* being opposite to the other end sections of the first arm members 11*a* where the hinge member 14 is provided. Similarly, there is also provided a second-arm reinforcement shaft 110*b* connected between two end sections of the second arm members 11*b* symmetrically provided with respect to the center line, the end sections of the second arm members 11*b* being opposite to the other end sections of the second arm members 11*b* where the hinge member 14 is provided. Further, the shape of the edge of the end sections of the arm members 11 (11*a* and 11*b*) on the side of the arm reinforcement shafts 110 (110*a* and 110*b*) is a circular arc, the position of the center of the circle of the circular arc shape being the same as the position of the arm reinforcement shaft 110.

Further, as shown in FIG. 10, in the first arm members 11*a*, on the side of the hinge member 14, there is formed a protrusion section 17 protruding from the side of the hinge member 14 to the side of the cap member 2.

Figure 16:
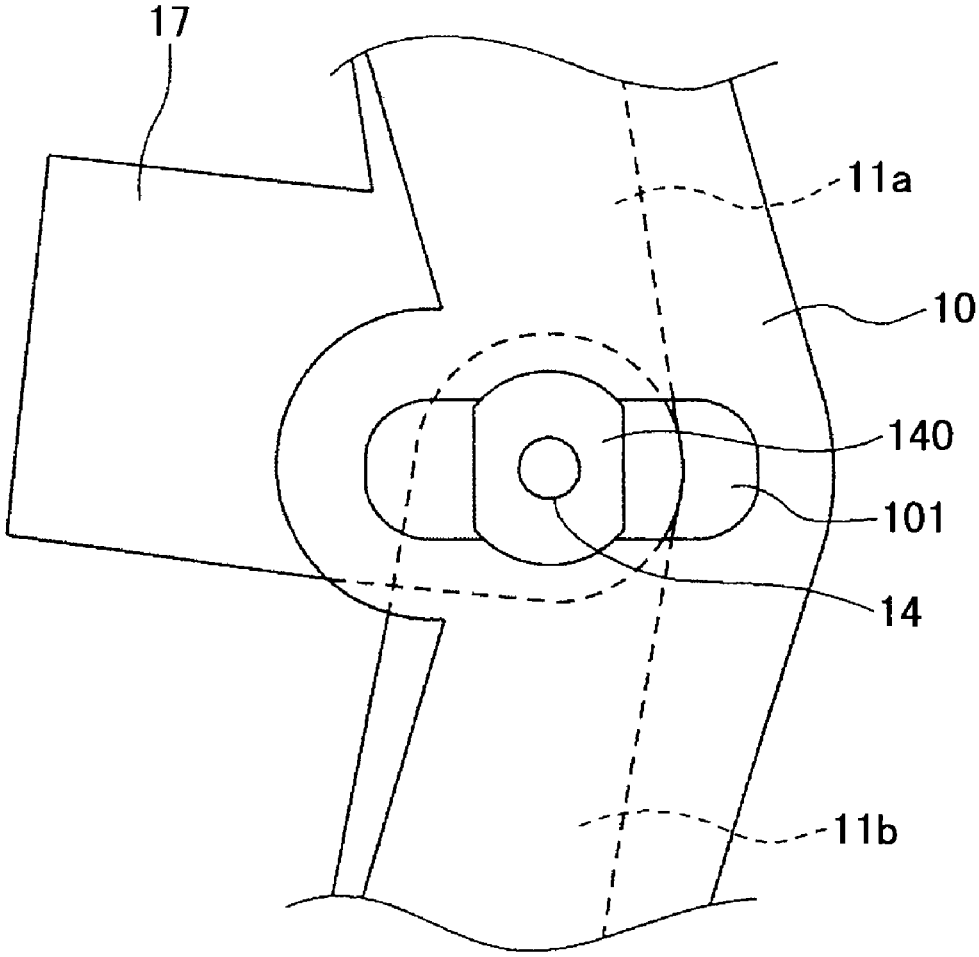
FIG. 16 is an enlarged schematic view showing a structure including a hinge member when viewed from the arrow M side in FIG. 14A.

As shown in FIGS. 12A and 12B, there are provided arm holders 10 which are fixed in position with respect to the cap member 2. The arm holder 10 holds the arm members 11. The arm holder 10 includes a holder elongated hole section having a holder elongated hole 101 to be engaged with the hinge member 14. The holder elongated hole 101 of the arm holder 10 is formed so that the longitudinal direction of the holder elongated hole 101 is parallel to the center line direction of the photoconductive sleeve member 1 when the cap member 2 is engaged with the photoconductive sleeve member 1. As a result, the position of the hinge member 14 in the vertical direction with respect to the cap member 2 is fixed. However, on the other hand, the position of the hinge member 14 in the center line direction (horizontal direction) with respect to the cap member 2 can be slidably changed (FIG. 16).

Further, as shown in FIG. 13, the arm holders 10 include a first shaft 13*a* on the upper side of the holder elongated hole 101 and a second shaft 13*b* on the lower side of the holder elongated hole 101 with respect to the center line. The first shaft 13*a* is disposed between and engaged with (inserted into) first arm elongated holes 12*a* formed on the respective first arm members 11*a*. The second shaft 13*b* is disposed between and engaged with (inserted into) second arm elongated holes 12*b* formed on the respective second arm members 11*b*. By having this engagement between the arm elongated holes 12 and the shafts 13, the arm members 11 are capable of moving in the longitudinal direction of the arm elongated holes 12 (12*a* and 12*b*) with respect to the shafts 13 and also capable of rotating with respect to the shafts 13. The position of the shafts 13 of the arm holders 10 are fixed with respect to the cap member 2; therefore, the distance in the center line direction is constant between the positions where the shafts 13 are engaged with (inserted into) the arm elongated holes 12 and the cap member 2.

Further, as shown in FIG. 13, one end of the spring member 15*a* (hereinafter referred to as a first spring member 15*a*) is fixed to a point between the hinge member 14 of the first arm member 11*a* and the first arm elongated hole 12*a*. The other end of the first spring member 15*a* is fixed to the cap member 2. Similarly, one end of the spring member 15*b* (hereinafter referred to as a second spring member 15*b*) is fixed to a point between the hinge member 14 of the second arm member 11*b* and the second arm elongated hole 12*b*. The other end of the second spring member 15*b* is fixed to the cap member 2. As shown in FIG. 13, the spring members 15 are extended to be longer than the natural length of the spring members 15. Also, the distance in the center line direction is substantially constant between the arm elongated holes 12 of the arm members 11 and the cap members 2. Therefore, the biasing force of the spring member 15 is applied in a manner such that the one side of the arm member 11 where the hinge member 14 is disposed is pulled toward the side of the cap member 2.

As shown in FIG. 11B, the operation member 6 includes the eccentric cam section 6*a*, the operation lever section 6*b*, and a pushing section 6*c*. The operation member 6 is attached to the cap member 2 in a manner such that the operation member 6 can be rotated about the operation axis 60 when an operator grasps and operates (rotates) the operation lever section 6*b*. When the operation member 6 is in position as shown in FIGS. 8 through 12B, the eccentric cam section 6*a* is not in pressure-contact with the cap-member-side flange section 3*c* of the wheel member 3 and vice versa. However, on the other hand, when the operation member 6 is in position as shown in FIGS. 8 through 12B, the pushing section 6*c* of the operation member 6 pushes the protrusion section 17 of the first arm member 11*a*. Further, there is provided a lock member (not shown) in the cap member 2. By using the lock member, the operation member 6 capable of being rotated about the operation axis 60 can be fixed in position as shown in FIGS. 8 through 12B.

This pushing structure is described in more detail with reference to FIGS. 11B and 12B which are enlarged cross-sectional views of the structure including the operation member 6 and the arm member 11. As described above, the first spring member 15*a* shown in FIG. 11B and the second spring member 15*b* shown in FIG. 12B are extended to be longer than the natural length. Therefore, the spring member 15 applies a biasing force in the arrow direction Q shown in FIGS. 11B and 12B with respect to the arm member 11. However, as described above, the protrusion section 17 is in pressure-contact with (pushing) the pushing section 6*c* of the operation member 6, which prevents the arm member 11 from moving in the arrow direction Q (in FIGS. 11B and 12B) beyond the position shown in FIGS. 8 through 12B. Further, in the state shown in FIGS. 8 through 12B, the end of the arm member 11 on the side of the arm reinforcement shaft 110 is not in contact with the inner circumferential surface of the photoconductive sleeve member 1; that is, the engagement is released between the cap member 2 and the photoconductive sleeve member 1.

Further, as shown in FIGS. 11B and 12B, the hinge member 14 is inserted into, in the order of, from outside with respect to the center line, a shaft hole formed on the second arm member 11*b*, a shaft hole formed on the first arm member 11*a*, and the holder elongated hole 101. Further, the end section (on the center line side) of the hinge member 14 is secured by a hinge nut 140. The hinge member 14 pivotally supports the arm members 11 so that the first arm member 11*a* and the second arm member 11*b* can be rotated with respect to each other and with respect to the arm holder 10. Further, due to the engagement between the hinge member 14 and the holder elongated hole 101 as shown in FIGS. 11B and 12B, the positions of the shaft holes of the first arm member 11*a* and the second arm member 11*b* can be slidably moved in the center line direction with respect to the arm holder 10 and the cap member 2 to which the arm holder 10 is fixed.

Next, to replace the photoconductive sleeve member 1, first, the lock member is released so that the operation members 6 can be moved (rotated). Then, the operation members 6 are pulled in the arrow direction Q in FIG. 12B (rotated in the arrow directions J in FIG. 14A) until the operation members 6 are in position shown in FIGS. 14A and 14B. By pulling the operation members 6 as described above, the pressure-contact between the pushing sections 6*c* and the protrusion sections 17 are released. As a result, the arm member 11 can be further moved in the arrow direction Q compared to the position shown in FIGS. 11B and 12B. This movement of the arm member 11 is caused by the biasing force of the spring member 15. In this movement of the arm member 11, the position where the arm member 11 is engaged with the shaft 13 within the arm elongated hole 12 is slid to the side of the hinge member 14 and the arm member 11 is rotated about the shaft 13. Further, the hinge member 14 is slid along the holder elongated hole 101 to the side of the cap member 2. As a result, as shown in FIG. 13, the end of the arm member 11 on the side of the arm reinforcement shaft 110 comes in contact with the inner circumferential surface of the photoconductive sleeve member 1. Further, as schematically shown in FIG. 14B, the spring member 15 is compressed to be shorter than the length of the spring member 15 in FIGS. 11B and 12B. However, the length of the spring member 15 in FIG. 14B is still longer than the natural length of the spring member 15; therefore, a biasing force of the spring member 15 is still applied so that the other end of the arm member 11 on the side of the hinge member 14 is pulled to the side of the cap member 2. Simultaneously, due to the biasing force of the spring member 15, the ends of the two arm members 11 on the side of the arm reinforcement shaft 110 press the inner circumferential surface of the photoconductive sleeve member 1, so that the cap member 2 is engaged with the photoconductive sleeve member 1.

FIG. 16 is an enlarged schematic view showing a structure around the hinge member 14 when viewed from M arrow side in FIG. 14A. As shown in FIG. 16, the hinge member 14 is slidably provided along the holder elongated hole 101 in the center line direction. Due to this feature, the positions of the ends of the two arm members 11 on the side of the hinge member 14 can be slidably moved with respect to the cap member 2 in the center line direction.

Figure 17:
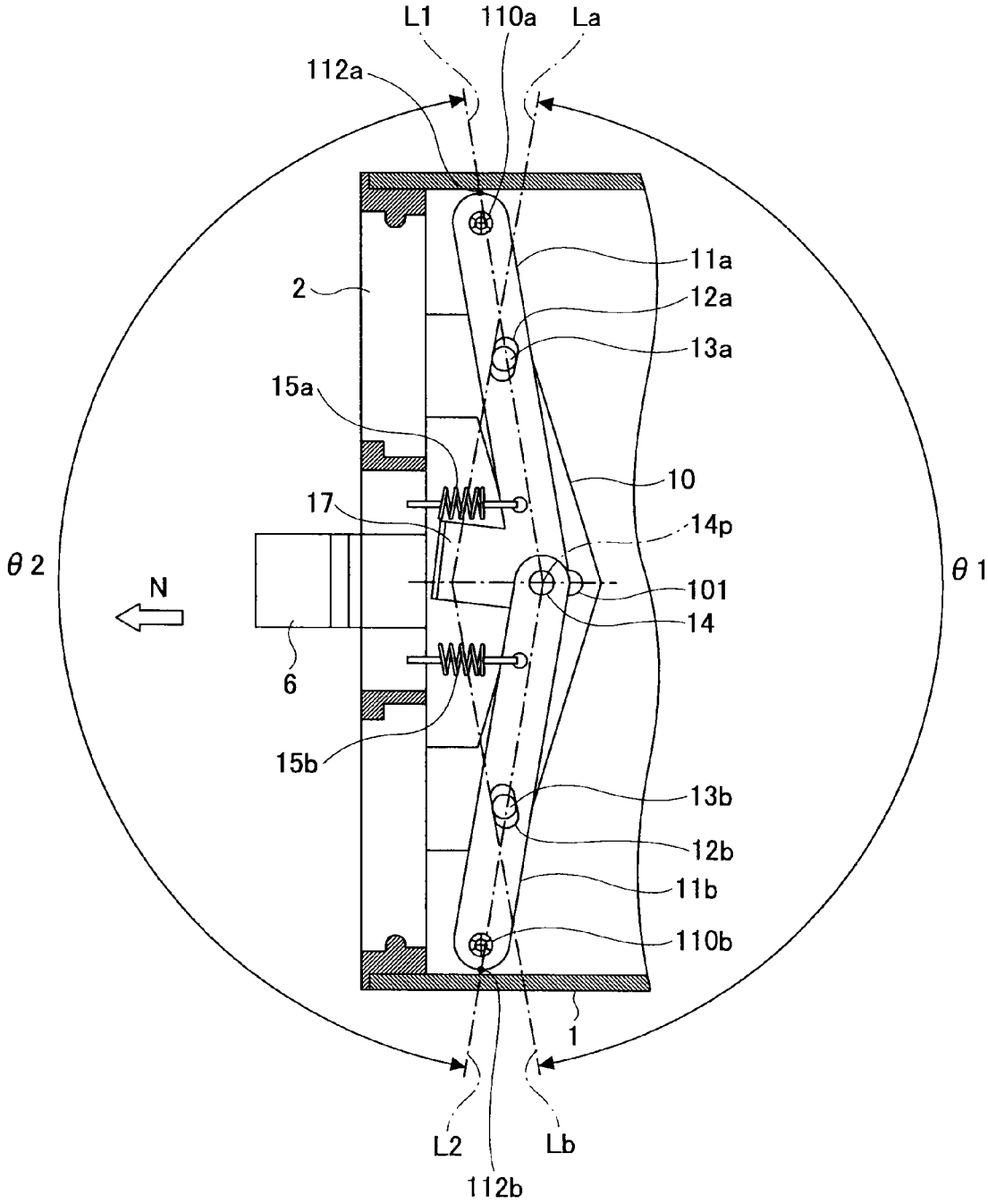
FIG. 17 is an enlarged schematic view showing a structure including arm members when the photoconductive sleeve member is engaged with the cap member.

FIG. 17 is an enlarged schematic view showing a structure including the arm members 11 when the photoconductive sleeve member 1 is engaged with the cap member 2 as shown in FIG. 13. In the following, operations in the photoconductive drum 100 are described when the cap member 2 is pulled in the arrow direction N in FIG. 17 while the photoconductive sleeve member 1 is engaged with the cap member 2.

In a case where the cap member 2 is pulled in the arrow direction N in FIG. 17, if the cap member 2 is sufficiently engaged with the photoconductive sleeve member 1 and the position of the cap member 2 with respect to the photoconductive sleeve member 1 is unchanged, the photoconductive sleeve member 1 is slid (moved) in the arrow direction N in FIG. 17 along with the cap member 2.

On the other hand, when the cap member 2 is pulled in the arrow direction N in FIG. 17, if the position of the cap member 2 with respect to the photoconductive sleeve member 1 is changed in the arrow direction N in FIG. 17, the shafts 13 of the arm holder 10 fixed to the cap member 2 are also moved in the arrow direction N in FIG. 17, so that the shafts 13 pull the arm members 11 in the arrow direction N at the position where the shafts 13 are engaged with the arm elongated holes 12 of the arm members 11.

In this case, when the ends of the arm members 11 on the side of the arm reinforcement shafts 110 are in contact with the photoconductive sleeve member 1 at contacting sections 112 (112*a* and 112*b* in FIG. 17) with enough friction force so as not to slip on the contacting sections 112*a* and 112*b* with respect to the photoconductive sleeve member 1, the arm members 11 are rotated in a manner such that the ends of the arm members 11 on the sides of the arm reinforcement shafts 110 roll on the inner circumferential surface of the photoconductive sleeve member 1. As described above, the ends of the two arm members 11 on the sides of the arm reinforcement shafts 110 are formed in a circular arc shape with the respective arm reinforcement shafts 110 being the centers of the circular arcs; therefore, the two arm members 11 are rotated about the respective arm reinforcement shafts 110.

As described above, when the arm members 11 are pulled in the arrow direction N at the positions in the arm elongated holes 12 and are rotated about the arm reinforcement shafts 110, the hinge member 14 moves in the arrow direction N in a manner such that the moving distance of the hinge member 14 in the center line direction is longer than the moving distance of the cap member 2 in the center line distance. As described above, when the hinge member 14 moves in the arrow direction N, the hinge member 14 approaches the shafts 13 ("moving distance of shaft 13"="moving distance of cap member 2"<"moving distance of hinge member 14"). Because of this feature, the force caused by the movement of the hinge member 14 is applied so that the shafts 13 within the arm elongated holes 12 slide to the side of (approach) the hinge member 14, thereby rotating the two arm members 11 to open the angle between longitudinal directions of the arm members 11 (hereinafter may be simplified as open the arm members 11).

By having the configuration as described above, the larger the moving distance (displacement) of the cap member 2 with respect to the photoconductive sleeve member 1 in the center line direction becomes, the larger is the pressing force applied to the contacting sections 112 between the arm members 11 and the inner circumferential surface of the photoconductive sleeve member 1, thereby reinforcing the engagement between the cap member 2 and the photoconductive sleeve member 1. Because of this feature, even when a large pressing force is temporarily applied to the contacting section 112, the engagement can be maintained between the cap member 2 and the photoconductive sleeve member 1. Further, as long as the position of the cap member 2 with respect to the photoconductive sleeve member 1 is not displaced outward in the center line direction, the pressing force applied to the contacting sections 112 is unchanged, and is based on the pressing force due to the biasing force of the spring members 15. Because of this feature, a large pressing force may not be applied when no such large pressing force is required to the contacting sections 112 where the cap member 2 is engaged with the photoconductive sleeve member 1.

As shown in FIG. 17, when the arm members 11 are in contact with the inner circumferential surface of the photoconductive sleeve member 1, a virtual angle $\theta_1$ is less than 180 degrees. Herein, the virtual angle $\theta_1$ is defined as one of two angles formed between two virtual lines La and Lb and is the angle formed on the side opposite to the side of the cap member 2. The virtual lines La and Lb are parallel to the longitudinal directions of the first arm elongated hole 12*a* and the second arm elongated hole 12*b* of the first arm member

11*a* and the second arm member 11*b*, respectively. In other words, the arm elongated hole 12 is formed in a manner such that the angle between the center line of the photoconductive sleeve member 1 and the longitudinal direction of the arm elongated hole 12 is not 90 degrees (i.e., the longitudinal direction of the arm elongated hole 12 is tilted with respect to the center line of the photoconductive sleeve member 1).

As described above, when the position of the cap member 2 with respect to the photoconductive sleeve member 1 is displaced in the arrow direction N in FIG. 17, component forces are produced from the two shafts 13 with respect to the respective two arm elongated holes 12. The component forces are applied so as to rotate the two arm members 11 to open the arm members 11.

The longitudinal direction of the arm elongated holes 12 with respect to the center line direction defines the magnitude of the force to be applied to open the arm members 11. When the longitudinal directions of the arm elongated holes 12 are as shown in FIG. 17 and then the cap member 2 is moved outward in the center line direction with respect to the photoconductive sleeve member 1, component forces from the shafts 13 acting on the arm members 11 are produced and applied so as to open the arm members 11. Because of this feature, when compared with a case where the longitudinal directions of the arm elongated holes 12 are parallel to the longitudinal directions of the respective arm members 11, less force is required to open the arm members 11. Namely, according to this embodiment of the present invention, the longitudinal directions of the arm elongated holes 12 are tilted with respect to the longitudinal directions of the respective arm members 11 to ensure movement (rotation) of the arm members 11.

Further, as shown in FIG. 17, when the two arm members 11 are in contact with the inner circumferential surface of the photoconductive sleeve member 1, a cap-member-side virtual angle $\theta_2$ is less than 180 degrees. Herein, the cap-member-side virtual angle $\theta_2$ is defined as one of two angles formed between two virtual lines L1 and L2 and is the angle formed on the side of the cap member 2. The lines L1 and L2 are parallel to the virtual lines extending between the contacting sections 112*a* and 112*b*, respectively, and a hinge center axis 14*p*. The hinge center axis 14*p* serves as a rotation axis of the rotation of the arm members 11 about the hinge member 14.

As described above, when the cap member 2 is pulled in the arrow direction N in FIG. 17, the cap member 2 with respect to the photoconductive sleeve member 1 is displaced in the arrow direction N. In this case, two arm members 11 are rotated about the respective arm reinforcement shafts 110 so that the hinge member 14 is moved to the side of the cap member 2. This rotation of the arm members 11 increases the cap-member-side virtual angle $\theta_2$ (opens the arm members 11).

In other words, when the cap member 2 is pulled in the arrow direction N in FIG. 17, the two arm members 11 are rotated so as to increase the cap-member-side virtual angle $\theta_2$ to open the arm members 11. However, in the state where the arm members 11 are in contact with the inner circumferential surface of the photoconductive sleeve member 1, it may be difficult to rotate the arm members 11 to increase the cap-member-side virtual angle $\theta_2$ to open the arm members 11. Because of this feature, in the state where the arm members 11 are in contact with the inner circumferential surface of the photoconductive sleeve member 1, when the cap member 2 with respect to the photoconductive sleeve member 1 in the center line direction is displaced in the arrow direction N in FIG. 17, the pressing forces are reinforced so that the arm members 11 are further pressed (wedged) into the inner circumferential surface of the photoconductive sleeve member 1.

By having the configuration as described above, the photoconductive sleeve member 1 and the cap member 2 may be engaged with each other more strongly. Therefore, it may become possible to ensure integrally removing the photoconductive sleeve member 1 and the cap member 2 from the wheel member 3.

In the photoconductive drum 100 according to this embodiment of the present invention, in the configuration of the engagement between the photoconductive sleeve member 1 and the cap member 2, the arm members 11 are provided to be rotated relative to each other (opened and closed) to act as wedges to be secured to the inner circumferential surface of the photoconductive sleeve member 1. By having this feature, when, for example, an operator holds the cap member 2 to replace the photoconductive sleeve member 1 and the photoconductive sleeve member 1 is about to be dropped off, a retention force may be increased so as to prevent the dropping of the photoconductive sleeve member 1. Because of this feature, when compared with a conventional photoconductive drum 100, it may become possible to reinforce the engagement between the cap member 2 and the photoconductive sleeve member 1, thereby enabling preventing, for example, damage of the photoconductive sleeve member 1 caused by being dropped off during the replacement.

On the other hand, as shown in FIGS. 13, 14A, 14B, 16, and 17, when the operation member 6 is rotated in the direction opposite to the arrow direction J in FIG. 14A, the pushing section 6*c* of the operation member 6 is in pressure-contact with (pushes) the protrusion section 17 of the first arm member 11*a* to move the protrusion section 17 to the right direction in the figures. By the movement of the protrusion section 17 of the first arm member 11*a* to the right direction, the ends of the two arm members 11 (11*a* and 11*b*) on the side of the hinge member 14 are accordingly moved to the right direction. As a result, the two arm members 11 (11*a* and 11*b*) are rotated to decrease the cap-member-side virtual angle $\theta_2$ to close the arm members 11, thereby separating the ends of the arm members 11 on the side of the arm reinforcement shaft 110 from the inner circumferential surface of the photoconductive sleeve member 1; therefore, the engagement between the cap member 2 and the photoconductive sleeve member 1 may be released.

In the description of this embodiment of the present invention, a case is described where the continuous web P is used as a recording medium to be printed in the printer 200 as an image forming apparatus using the photoconductive drum 100 having the features of the present invention. However, the present invention is not limited to this configuration using the continuous web. For example, any cut sheets such as A4 and B4 sized sheets may alternatively be used in the image forming apparatus according to an embodiment of the present invention.

Further, in this embodiment of the present invention, a case is described where, in the photoconductive drum 100 having the features of the present invention, the arm member 11 is provided serving as a sleeve inner circumferential surface pressing member having the function in which, when the positional displacement of the cap member 2 is generated with respect to the photoconductive sleeve member 1 outward in the center line direction while the sleeve inner circumferential surface pressing member is in contact with the inner circumferential surface of the photoconductive sleeve member 1, the positional displacement leads to increasing the pressing force of the sleeve inner circumferential surface pressing member to press the inner circumferential surface of the photoconductive sleeve member 1. However, the present invention is not limited to this configuration using the arm member 11 as the sleeve inner circumferential surface pressing member. Namely, any other element serving as the sleeve inner circumferential surface pressing member may be alternatively used as long as the element has the function of, when the positional displacement of the cap member 2 (more generally, a first end surface member) is generated with respect to the photoconductive sleeve member outward in the center line direction while the sleeve inner circumferential surface pressing member is in contact with the inner circumferential surface of the photoconductive sleeve member 1, the positional displacement is used (leads) to increase the pressing force of the sleeve inner circumferential surface pressing member to press the inner circumferential surface of the photoconductive sleeve member.

According to this embodiment of the present invention, the photoconductive drum 100 includes the photoconductive sleeve member 1, the cap member 2, the wheel member 3, and a contacting unit. The photoconductive sleeve member 1 having a hollow cylindrical shape has a photoconductive outer circumferential surface. The cap member 2 serves as the first end surface member engaging one end of the photoconductive sleeve member 1 in the center line direction of the photoconductive sleeve member 1. The wheel member 3 serves as the second end surface member engaging the other end of the photoconductive sleeve member 1 in the center line direction. The contacting unit is disposed in the cap member 2 and includes the operation member 6 to be operated to select between a contacting mode and a non-contacting mode. In the contacting mode, the cap member 2 is engaged with the photoconductive sleeve member 1. On the other hand, in the non-contacting mode, the engagement is released between the cap member 2 and the photoconductive sleeve member 1. To engage the cap member 2 with the photoconductive sleeve member 1, the contacting unit in the cap member 2 further includes the arm member 11 serving as the sleeve inner circumferential surface pressing member to be operated to select between the state where the sleeve inner circumferential surface pressing member is in contact with and pressing the inner circumferential surface of the photoconductive sleeve member 1 and the state where the sleeve inner circumferential surface pressing member is not in contact with the inner circumferential surface of the photoconductive sleeve member 1. Further, in the state where the sleeve inner circumferential surface pressing member is not in contact with the inner circumferential surface of the photoconductive sleeve member 1, the engagement is released between the cap member 2 and the photoconductive sleeve member 1. In the state where the engagement is released, the operation member 6 can be operated so that the arm member 11 is in contact with and presses the inner circumferential surface of the photoconductive sleeve member 1. By doing this, the cap member 2 is engaged with the photoconductive sleeve member 1. The photoconductive drum 100 according to this embodiment of the present invention having the features as described above includes the mechanism as described above. Namely, in the mechanism, after the arm member 11 is in contact with the inner circumferential surface of the photoconductive sleeve member 1 and when the position of the cap member 2 with respect to the photoconductive sleeve member 1 is displaced outward in the center line direction, the displacement of the cap member 2 leads to increasing the pressing force applied from the arm member 11 to the inner circumferential surface of the photoconductive sleeve member 1. By having this mechanism, if a force is applied exceeding the maximum static friction force generated between the arm member 11 and the inner circumferential surface of the photoconductive sleeve member 1 upon the cap member 2 being engaged with the photoconductive sleeve member 1 due to the operation of the operation member 6 and even when the position of the cap member 2 with respect to the photoconductive sleeve member 1 displaces outward in the center line direction, the displacement of the cap member 2 leads to increasing the pressing force applied from the arm member 11 to the inner circumferential surface of the photoconductive sleeve member 1. Because of this feature, the larger the displacement is, the larger is the pressing force applied to the contacting sections 112*a* and 112*b* where the arm members 11 are in contact with the inner circumferential surface of the photoconductive sleeve member 1. As a result, the engagement may be reinforced between the cap member 2 and the photoconductive sleeve member 1. Because of this feature, even when an extraordinary force is temporarily applied to the contacting sections 112*a* and 112*b*, the engagement may be maintained between the cap member 2 and the photoconductive sleeve member 1. On the other hand, as long as the position of the cap member 2 with respect to the photoconductive sleeve member 1 is not displaced outward in the center line direction, the pressing force applied to the contacting sections 112*a* and 112*b* where the arm members 11 are in contact with the inner circumferential surface of the photoconductive sleeve member 1 is equal to the force applied when the cap member 2 is engaged with the photoconductive sleeve member 1 due to the operation of the operation member 6. Because of this feature, when the cap member 2 is engaged with the photoconductive sleeve member 1 and if no extraordinary pressing force is required to be applied to the contacting sections 112*a* and 112*b* where the arm members 11 are in contact with the inner circumferential surface of the photoconductive sleeve member 1, such extraordinary pressing force may not be generated to be applied to the contacting sections. Therefore, in the photoconductive drum 100 according to this embodiment of the present invention, when the cap member 2 is engaged with the photoconductive sleeve member 1 and no extraordinary pressing force is required to be applied to the contacting sections where the arm members 11 are in contact with the inner circumferential surface of the photoconductive sleeve member 1, it may become possible to avoid the generation of such extraordinary pressing force to be applied to the contacting sections. Further, even when an extraordinary pressing force is temporarily applied to the contacting sections 112*a* and 112*b*, the engagement may be maintained between the cap member 2 and the photoconductive sleeve member 1.

Further, as described above, the contacting unit of the photoconductive drum 100 according to this embodiment of the present invention includes the arm members 11, the arm holder 10, the spring members 15, the hinge member 14 and the like.

Further, in the photoconductive drum 100 according to this embodiment of the present invention, as the sleeve inner circumferential surface pressing member, two arm members 11 are provided. The hinge member 14 pivotally supports the arm members 11 so that the arm members 11 (the first arm member 11*a* and the second arm member 11*b*) can be rotated with respect to each other. The arm members 11 are rotatably connected with respect to each other so that each of the arm members 11 rotates about the hinge center axis 14*p* which is a first virtual axis orthogonal to the center line of the photoconductive sleeve member 1. Further, the arm members 11 (the first arm member 11*a* and the second arm member 11*b*) are provided so that the arm members 11 can be in contact with the inner circumferential surface of the photoconductive sleeve member 1 and disposed opposite to each other with respect to a virtual plane including the hinge center axis 14*p* and the center line of the photoconductive sleeve member 1. In other words, each of the arm members 11 is disposed one on each of the opposite sides (i.e., the upper side and the lower side) with respect to the horizontal plane including the hinge center axis 14*p*. Further, in the state where the two arm members 11 are in contact with the inner circumferential surface of the photoconductive sleeve member 1, the cap-member-side virtual angle $\theta_2$ is less than 180 degrees. Herein, the cap-member-side virtual angle $\theta_2$ is one of two angles formed between two virtual lines L1 and L2 and is the angle formed on the side of the cap member 2. The lines L1 and L2 are parallel to the virtual lines extending between the contacting sections 112*a* and 112*b*, respectively, and the hinge center axis 14*p*. The hinge center axis 14*p* serves as a rotation axis of the rotation of the arm members 11 about the hinge member 14. Further, there are provided the spring member 15, the pushing section 6*c* of the operation member 6, and the protrusion section 17 of the first arm member 11*a*. The spring member 15 is the biasing member capable of applying a biasing force to the arm members 11 so as to increase the cap-member-side virtual angle $\theta_2$ between the arm members 11. The pushing section 6*c* of the operation member 6 serves as a biasing prevention unit to be operated against the biasing force to select the state where the arm members 11 are not in contact with the photoconductive sleeve member 1 by decreasing the cap-member-side virtual angle $\theta_2$ due to the operation of the operation member 6 to release the engagement between the cap member 2 and the photoconductive sleeve member 1. Further, in the state where the arm members 11 are in contact with the inner circumferential surface of the photoconductive sleeve member 1 and when the biasing force generated by the spring members 15 is applied to the arm members 11 so as to increase the cap-member-side virtual angle $\theta_2$, the engagement between the cap member 2 and the photoconductive sleeve member 1 may be reinforced. Further, the cap member 2 includes the arm holder 10 serving as a to-be-held section for the arm members 11, the arm holder 10 holding the arm members 11 in the arm elongated holes 12. The arm holder 10 fixes the position of the arm elongated holes 12 with respect to the cap member 2 in the center line direction. Further, the arm holder 10 pivotally supports the arm members 11 so that the arm members 11 can be rotated with respect to the arm holder 10 about the respective center axes of the shafts 13, the center axes being parallel to the hinge center axis 14*p*.

In this configuration, the position of the to-be-held section of the shaft 13 in the arm elongated hole 12 is fixed in position with respect to the cap member 2 in the center line direction. Because of this feature, when the position of the cap member 2 with respect to the photoconductive sleeve member 1 in the center line direction is displaced, the arm members 11 at the to-be-held section are to be moved in the center line direction along with the cap member 2. However, the ends of the arm members 11 on the side of the arm reinforcement shafts 110 are in pressure-contact with the inner circumferential surface of the photoconductive sleeve member 1 so as to press the inner circumferential surface of the photoconductive sleeve member 1. Because of this contact, the movement of the ends of the arm members 11 on the side of the arm reinforcement shafts 110 in the center line direction is controlled due to the friction force generated between the arm members 11 and the inner circumferential surface of the photoconductive sleeve member 1. As described above, with respect to the arm members 11, the force to move the arm members 11 in the center line direction is applied to the to-be-held section; and, on the other hand, the other force to retain the position of the arm members 11 with respect to the photoconductive sleeve member 1 at the ends of the arm members 11 on the side of the arm reinforcement shafts 110. Due to the forces applied to the arm members 11 as described above, a moment is generated and applied to the arm members 11 tending to rotate the arm members 11 about an axis passing near the ends of the arm members 11 on the side of the arm reinforcement shafts 110 as the center of the rotation. In this state, the arm members 11 are rotatably supported with respect to the arm holder 10 at the to-be-held section of the arm holder 10. Further, the arm members 11 are rotatably supported by the hinge member 14 so as to be rotated with respect to each other. Because of this feature, due to the moment applied to the arm members 11, the arm members 11 rotate in a manner such that the ends of the arm members 11 on the side of the hinge member 14 move to the side of the cap member 2. Two arm members 11 (11*a* and 11*b*) are simultaneously rotated in the opposite directions about the respective axes near the ends of the arm members 11 on the side of the arm reinforcement shafts 110 as the centers of the rotations in a manner such that the ends of the arm members 11 on the side of the hinge member 14 move to the side of the cap member 2. Because of this movement (rotation), the force is applied to increase the cap-member-side virtual angle $\theta_2$, to open the arm members 11, thereby increasing the pressing force applied from the arm members 11 to the inner circumferential surface of the photoconductive sleeve member 1. By having this feature, it may become possible to have a mechanism in which, when the arm members 11 are in contact with the inner circumferential surface of the photoconductive sleeve member 1, the displacement of the cap member 2 with respect to the photoconductive sleeve member 1 in the center line direction leads to increasing the pressing force applied from the arm members 11 to the inner circumferential surface of the photoconductive sleeve member 1.

Further, in the photoconductive drum 100 according to this embodiment of the present invention, the arm member 11 includes the arm elongated hole 12 formed between the position where the hinge member 14 is to be attached and the position where the arm reinforcement shaft 110 is to be attached. Then, the arm holder 10 pivotally supports the arm members 11 so that the arm members 11 can be rotated about the respective center axes (second virtual axes) of the shafts 13. The hinge member 14 having the hinge center axis 14*p* which is a first virtual axis can be moved with respect to the cap member 2 in the center line direction. That is, the position of the first virtual axis is different from that of the second virtual axis, the first virtual axis serving as the center of the rotation of the arm member 11 (e.g. the first arm member 11*a*) with respect to the other arm member 11 (e.g. the second arm member 11*b*), the second virtual axis serving as the center of the rotation of the arm members 11 with respect to the arm holder 10, and the position of the second virtual axis with respect to the cap member 2 being fixed.

However, there may be alternative configurations of the present invention. More specifically, even if the first virtual axis and the second virtual axis are the same, the above mechanism may also be provided where, as described above, there are two arm members capable of being in contact with the inner circumferential surface of the photoconductive sleeve member 1 and the displacement of the cap member 2 with respect to the photoconductive sleeve member 1 in the center line direction leads to increasing the pressing force applied from the arm members 11 to the inner circumferential surface of the photoconductive sleeve member 1.

As an example of the above case where the first virtual axis and the second virtual axis are the same, in the state where the arm members are in contact with the inner circumferential surface of the photoconductive sleeve member 1 in a manner such that the cap-member-side virtual angle $\theta_2$ is less than 180 degrees, the position of the hinge member 14 is fixed with respect to the cap member 2. In this configuration, the hinge center axis 14*p* of the hinge member 14 may serve as the first virtual axis and the second virtual axis at the same time.

More specifically, in this configuration, when the position of the cap member 2 with respect to the photoconductive sleeve member 1 is displaced, one force is applied to a portion where the arm member 11 is engaged with the hinge member 14 so that the hinge member is moved along the cap member 2 in the center direction and the other force is applied to the contacting sections where the arm members are in contact with the photoconductive sleeve member 1 so as to retain the position of the arm members 11 with respect to the photoconductive sleeve member 1, thereby generating a moment tending to rotate the arm members 11 about the respective axes near the ends of the arm members 11 on the side of the arm reinforcement shafts 110 as the centers of the rotations. In this case, the arm members 11 are rotatably supported by the hinge member 14 with respect to the cap member 2. Further, the arm members 11 are rotatably supported with respect to each other. Because of the feature, due to the moment, the two arm members 11 rotate in the directions opposite to each other about the respective axes near the ends of the arm members 11 on the side of the arm reinforcement shafts 110 as the centers of the rotations in a manner such that the hinge member 14 moves along with the cap member 2. Due to the rotations, a force is applied to the arm members 11 so as to increase the cap-member-side virtual angle $\theta_2$ to open the arm members 11. As a result, the pressing force applied from the arm members 11 to the inner circumferential surface of the photoconductive sleeve member 1 may be increased. Therefore, in this configuration, the displacement of the position of the cap member 2 with respect to the photoconductive sleeve member 1 in the center line direction may lead to increasing the pressing force applied from the arm members 11 to the inner circumferential surface of the photoconductive sleeve member 1.

Further, in the photoconductive drum 100 according to this embodiment of the present invention, the to-be-held section for the arm members 11 refers to a contact section between the arm elongated hole 12 and the shaft 13. The arm elongated hole 12 is formed on the arm members 11 and between the contacting section 112 where the arm member 11 is in contact with the inner circumferential surface of the photoconductive sleeve member 1 and the hinge member 14 pivotally supporting the arm members 11 so that the arm members 11 can be rotated with respect to each other. The arm members 11 are supported by the arm holder 10 in a manner such that the hinge member 14 with respect to the cap member 2 is slidably moved in the center direction. Further, in the state when the arm member 11 is in contact with the inner circumferential surface of the photoconductive sleeve member 1, the virtual angle $\theta_1$ is less than 180 degrees. The virtual angle $\theta_1$ is one of two angles formed between two virtual lines La and Lb and is the angle formed on the side opposite to the side of the cap member 2. The virtual lines La and Lb are parallel to the longitudinal directions of the respective arm elongated holes 12 of the arm members 11. By having this configuration, in the state where the arm members 11 are in contact with the inner circumferential surface of the photoconductive sleeve member 1, when the cap member 2 with respect to the photoconductive sleeve member 1 is displaced, the component forces are applied from the shaft 13 positioned between two arm members 11 to the arm elongated holes 12 formed in the arm members 11. The component forces are more likely to be applied so as to increase the cap-member-side virtual angle $\theta_2$ to open the arm members 11 due to the tilted direction of the elongated holes 12. Because of this feature, it may become possible to reinforce the pressing force applied from the arm members 11 to the inner circumferential surface of the photoconductive sleeve member 1, thereby reinforcing the engagement between the cap member 2 and the photoconductive sleeve member 1.

Further, one end of the spring member 15 which is the biasing member in the photoconductive drum 100 according to this embodiment of the present invention is fixed to a point between the hinge member 14 of the arm member 11 and the arm elongated hole 12. The other end of the spring member 15 is fixed to the cap member 2. Further, the biasing force is applied so as to shorten the length between the ends. Because of this feature, the biasing force of the spring member 15 may be applied to the arm member 11 to increase the cap-member-side virtual angle $\theta_2$ to open the arm members 11.

Further, in the photoconductive drum 100 according to this embodiment of the present invention, the photoconductive sleeve member 1 is fixed in position with respect to the cap member 2 and the wheel member 3 by engaging the end of the photoconductive sleeve member 1 in the center line direction with the cap member 2 and engaging the other end of the photoconductive sleeve member 1 in the center line direction with the wheel member 3. Then the wheel member 3 is attached to the driving shaft 4 provided in the main body of the printer 200 which is an image forming apparatus. By having this configuration, the photoconductive sleeve member 1 may be engaged with the driving shaft 4, and by rotating the driving shaft 4, it may become possible to rotate the photoconductive drum 100, thereby rotating the surface of the photoconductive sleeve member 1.

Further the printer 200 includes a photoconductive drum 100 and the charging device 19, the exposure device 20, the development device 21, and a corona transfer device 43. The photoconductive drum 100 has a photoconductive outer circumferential surface. The charging device 19 serves as charging means to charge the outer circumferential surface of the photoconductive drum 100. The exposure device 20 serves as latent image forming means to form a latent image on the charged outer circumferential surface of the photoconductive drum 100. The development device 21 serves as development means to develop the latent image on the outer circumferential surface of the photoconductive drum 100 and to form the toner image. The corona transfer device 43 serves as transfer means to transfer the toner image on the outer circumferential surface of the photoconductive drum 100 to the continuous web P as a recording medium. Further, as the photoconductive drum, the photoconductive drum 100 as described with reference to FIGS. 5 through 17 is adopted. By having the photoconductive drum 100 in the printer 200, upon replacing a used photoconductive sleeve member 1 with a new photoconductive sleeve member 1, the photoconductive sleeve member 1 may be replaced without touching the surface of the photoconductive sleeve member 1 with a hand or tool. Further, it may become possible to prevent the photoconductive sleeve member 1 from being dropped off during the replacement operation. As a result, it may become possible to improve the operability in replacing the photoconductive sleeve member 1.

Further, according to an embodiment of the present invention, the sleeve inner circumferential surface pressing member 11 in the contacting unit includes two arm members 11*a* and 11*b* which are rotatably connected with respect to each other;

the arm members 11*a* and 11*b* are rotatable with respect to each other about a first virtual axis orthogonal to the center line of the photoconductive sleeve member 1 and upon being rotated, the arm members 11 (11*a* and 11*b*) can be in contact with the inner circumferential surface of the photoconductive sleeve member 1 to be disposed opposite to each other with respect to a virtual plane including the first virtual axis 14*p* and the center line of the photoconductive sleeve member 1;

in the state where the arm members 11 (11*a* and 11*b*) are in contact with the inner circumferential surface of the photoconductive sleeve member 1, a first-end-surface-member-side virtual angle $\theta_2$ is less than 180 degrees, the first-end-surface-member-side virtual angle $\theta_2$ being one of two virtual angles formed between two virtual lines (L1 and L2) and being the angle formed on a side of the first end surface member 2, the virtual lines (L1 and L2) extending between respective contacting sections (112*a* and 112*b*) and the first virtual axis 14*p*, the contacting sections (112*a* and 112*b*) being between the respective arm members 11 (11*a* and 11*b*) and the inner circumferential surface of the photoconductive sleeve member 1;

the contacting unit further includes a biasing members 15 and biasing prevention units 6*c*, the biasing members 15 being capable of applying a biasing force to the arm members 11 so as to increase the first-end-surface-member-side virtual angle $\theta_2$, the biasing prevention units 6*c* being capable of releasing the engagement between the arm members 11 and the photoconductive sleeve member 1 by decreasing the first-end-surface-member-side virtual angle $\theta_2$ against the biasing force due to the operation of the operation members 6 to release the engagement;

in the state where the arm members 11 are in contact with the inner circumferential surface of the photoconductive sleeve member 1, the contacting unit is capable of engaging the first end surface member 2 with the photoconductive sleeve member 1 by applying the biasing force of the biasing members 15 to the arm members 11 to increase the first-end-surface-member-side virtual angle $\theta_2$;

the first end surface member 2 further includes an arm holding member 10 supporting the arm members 11 at to-be-held sections of the arm members 11; and the arm holding member 10 fixes positions of the to-be-held sections of the arm members 11 with respect to the first end surface member 2 in the center line direction and rotatably supports the arm members 11 so that the arm members 11 can rotate with respect to the arm holding member 10 about respective second virtual axes parallel to the first virtual axis.

Further, according to another embodiment of the present invention, the to-be-held section of the arm member 11 is a contact section where an arm elongated hole 12 is in contact with an arm holding axis 13, the arm elongated hole 12 being formed between the contacting section 112 and an arm connecting section, the contacting section 112 being between the arm member 11 and the inner circumferential surface of the photoconductive sleeve member 1, the arm connecting section being where the arm members 11 (11*a* and 11*b*) are rotatably connected, the arm holding axis 13 being provided at the arm holding member 10 so as to be engaged with the arm elongated hole 12;

the arm member 11 is supported by the arm holding member 10 in a manner such that the arm connecting section with respect to the first end surface member 2 in the center line direction is slidably moved; and in the where that the arm members 11 are in contact with the inner circumferential surface of the photoconductive sleeve member 1, a virtual angle $\theta_1$ is less than 180 degrees, the virtual angle $\theta_1$ being defined as one of two angles formed between two virtual lines (La and Lb) and is an angle formed on the side opposite to the side of the first end surface member 2, the virtual lines (La and Lb) being parallel to the longitudinal directions of the arm elongated holes 12 of the respective arm members 11.

Further, according to an embodiment of the present invention, the biasing member 15 is an elastic member with one end fixed to a point between the arm connecting section and the arm elongated hole 12 of the arm member 11 and with the other end fixed to the first end surface member 2, so that the biasing member 15 applies a biasing force to decrease the distance between the ends.

Further, according to an embodiment of the present invention, the photoconductive sleeve member 1 is retained in position with respect to the first end surface member 2 and the second end surface member 3 by sandwiching the photoconductive sleeve member 1 with the first end surface member 2 and the second end surface member 3 in a manner such that the end of the photoconductive sleeve member 1 in the center line direction is engaged with the first end surface member 2 and the other end of the photoconductive sleeve member 1 in the center line direction is engaged with the second end surface member 3, and at least one of the first end surface member 2 and the second end surface member 3 is able to be fixed to a driving shaft 4 of a main body of an image forming apparatus.

Further, according to an embodiment of the present invention, there is provided an image forming apparatus including:

the photoconductive drum described above;

a charging unit configured to charge the outer circumferential surface of the photoconductive drum;

a latent image forming unit configured to form a latent image on the charged outer circumferential surface of the photoconductive drum;

a development unit configured to develop the latent image on the outer circumferential surface of the photoconductive drum to form a toner image; and a transfer unit configured to transfer the toner image on the outer circumferential surface of the photoconductive drum to a recording medium.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A photoconductive drum comprising:

a photoconductive sleeve member having a hollow cylindrical shape and having a photoconductive outer circumferential surface;

a first end surface member configured to be engaged with an end of the photoconductive sleeve member in a center line direction of the photoconductive sleeve member;

a second end surface member configured to be engaged with another end of the photoconductive sleeve member in the center line direction of the photoconductive sleeve member;

a contacting unit disposed in the first end surface member and including an operation member, the contacting unit being configured to be operated to select one of a contacting mode and a non-contacting mode due to an operation of the operation member, the contacting mode indicating that the first end surface member is engaged with the photoconductive sleeve member, the non-contacting mode indicating that the engagement is released between the first end surface member and the photoconductive sleeve member; and a sleeve inner circumferential surface pressing member disposed in the contacting unit and configured to be operated due to the operation of the operation member to select one of a state where the sleeve inner circumferential surface pressing member is in contact with and presses an inner circumferential surface of the photoconductive sleeve member so that the first end surface member is engaged with the photoconductive sleeve member and a state where the sleeve inner circumferential surface pressing member is not in contact with the inner circumferential surface of the photoconductive sleeve member so that the engagement is released between the first end surface member and the photoconductive sleeve member, wherein the photoconductive drum includes a mechanism where, when the sleeve inner circumferential surface pressing member is in contact with the inner circumferential surface of the photoconductive sleeve member, a displacement of the first end surface member with respect to the photoconductive sleeve member in the center line direction leads to increasing a pressing force applied from the sleeve inner circumferential surface pressing member to the inner circumferential surface of the photoconductive sleeve member.

2. The photoconductive drum according to claim 1, wherein the sleeve inner circumferential surface pressing member in the contacting unit includes two arm members which are rotatably connected with respect to each other;

the arm members are rotatable with respect to each other about a first virtual axis orthogonal to the center line of the photoconductive sleeve member and upon being rotated, the arm members can be in contact with the inner circumferential surface of the photoconductive sleeve member to be disposed opposite to each other with respect to a virtual plane including the first virtual axis and the center line of the photoconductive sleeve member;

in the state where the arm members are in contact with the inner circumferential surface of the photoconductive sleeve member, a first-end-surface-member-side virtual angle is less than 180 degrees, the first-end-surface-member-side virtual angle being one of two virtual angles formed between two virtual lines and being the angle formed on a side of the first end surface member, the virtual lines extending between respective contacting sections and the first virtual axis, the contacting sections being between the respective arm members and the inner circumferential surface of the photoconductive sleeve member;

the contacting unit further includes biasing members and a biasing prevention unit, the biasing members being capable of applying a biasing force to the arm members so as to increase the first-end-surface-member-side virtual angle, the biasing prevention unit being capable of releasing the engagement between the arm members and the photoconductive sleeve member by decreasing the first-end-surface-member-side virtual angle against the biasing force due to the operation of the operation member to release the engagement;

in the state where the arm members are in contact with the inner circumferential surface of the photoconductive sleeve member, the contacting unit is capable of engaging the first end surface member with the photoconductive sleeve member by applying the biasing force of the biasing members to the arm members to increase the first-end-surface-member-side virtual angle;

the first end surface member further includes an arm holding member supporting the arm members at to-be-held sections of the arm members; and the arm holding member fixes positions of the to-be-held sections of the arm members with respect to the first end surface member in the center line direction and rotatably supports the arm members so that the arm members can rotate with respect to the arm holding member about respective second virtual axes parallel to the first virtual axis.

3. The photoconductive drum according to claim 2, wherein the to-be-held section of the arm member is a contact section where an arm elongated hole is in contact with an arm holding axis, the arm elongated hole being formed between the contacting section and an arm connecting section, the contacting section being between the arm member and the inner circumferential surface of the photoconductive sleeve member, the arm connecting section being where the arm members are rotatably connected, the arm holding axis being provided at the arm holding member so as to be engaged with the arm elongated hole;

the arm member is supported by the arm holding member in a manner such that the arm connecting section with respect to the first end surface member in the center line direction is slidably moved; and in the state where the arm members are in contact with the inner circumferential surface of the photoconductive sleeve member, a virtual angle is less than 180 degrees, the virtual angle being defined as one of two angles formed between two virtual lines and is an angle formed on the side opposite to the side of the first end surface member, the virtual lines being parallel to the longitudinal directions of the arm elongated holes of the respective arm members.

4. The photoconductive drum according to claim 3, wherein the biasing member is an elastic member with one end thereof being fixed to a point between the arm connecting section and the arm elongated hole of the arm member and with the other end thereof being fixed to the first end surface member, so that the biasing member applies a biasing force to decrease the distance between the ends.

5. The photoconductive drum according to claim 1, wherein the photoconductive sleeve member is retained in position with respect to the first end surface member and the second end surface member by sandwiching the photoconductive sleeve member with the first end surface member and the second end surface member in a manner such that the end of the photoconductive sleeve member in the center line direction is engaged with the first end surface member and the other end of the photoconductive sleeve member in the center line direction is engaged with the second end surface member, and one of the first end surface member and the second end surface member is able to be fixed to a driving shaft of a main body of an image forming apparatus.

6. An image forming apparatus comprising:

the photoconductive drum according to claim 1;

a charging unit configured to charge the outer circumferential surface of the photoconductive drum;

a latent image forming unit configured to form a latent image on the charged outer circumferential surface of the photoconductive drum;

a development unit configured to develop the latent image on the outer circumferential surface of the photoconductive drum to form a toner image; and a transfer unit configured to transfer the toner image on the outer circumferential surface of the photoconductive drum to a recording medium.

* * * * *